US011648439B2

(12) United States Patent
Lagree et al.

(10) Patent No.: US 11,648,439 B2
(45) **Date of Patent: *May 16, 2023**

(54) EXERCISE MACHINE HANDLE SYSTEM

(71) Applicant: Lagree Technologies, Inc., Chatsworth, CA (US)

(72) Inventors: Sebastien Anthony Louis Lagree, Chatsworth, CA (US); Samuel D. Cox, Yuba City, CA (US); Todd G. Remund, Yuba City, CA (US)

(73) Assignee: Lagree Technologies, Inc., Chatsworth, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/902,004

(22) Filed: Sep. 2, 2022

(65) Prior Publication Data

US 2022/0409949 A1 Dec. 29, 2022

Related U.S. Application Data

(63) Continuation of application No. 17/144,771, filed on Jan. 8, 2021, now Pat. No. 11,433,272.

(Continued)

(51) Int. Cl.
*A63B 21/00* (2006.01)
*A63B 22/20* (2006.01)

(52) U.S. Cl.
CPC ..... *A63B 21/4035* (2015.10); *A63B 21/4045* (2015.10); *A63B 22/203* (2013.01)

(58) Field of Classification Search
CPC ..... A63B 21/0428; A63B 2225/09; A63B 2225/102; A63B 21/0442; A63B 2210/50; A63B 21/0552; A63B 21/068; A63B 23/03566; A63B 21/4045; A63B 22/203; A63B 69/0057; A63B 21/00058–00065; A63B 21/02–025; A63B 21/04; A63B 21/0407; A63B 21/05; A63B 21/055–0557; A63B 21/4033–4035; A63B 22/0076–0089; A63B 22/0087–0089; A63B 2022/0084
See application file for complete search history.

(56) References Cited

U.S. PATENT DOCUMENTS 1,621,477 A 3/1927 Pilates
3,586,322 A * 6/1971 Kverneland ..... A63B 22/0076 482/38

(Continued)

FOREIGN PATENT DOCUMENTS

WO 2004096376 A1 11/2004

OTHER PUBLICATIONS

Non-Final Office Action Document for U.S. Appl. No. 17/002,463.

*Primary Examiner* — Joshua Lee
*Assistant Examiner* — Catrina A Letterman
(74) *Attorney, Agent, or Firm* — Neustel Law Offices

(57) ABSTRACT

An exercise machine handle system for providing a gripping structure that substantially surrounds a stationary or movable exercise platform. The exercise machine handle system generally includes a stationary or movable exercise platform and a perimeter handle surrounding the exercise platform. A space is formed between an outer edge of the exercise platform and an inner edge of the perimeter handle that allows a plurality of fingers of an exerciser to extend through.

20 Claims, 14 Drawing Sheets

Related U.S. Application Data

(60) Provisional application No. 62/961,780, filed on Jan. 16, 2020.

(56) References Cited

U.S. PATENT DOCUMENTS

| | | | | |
|---|---|---|---|---|
| 3,770,267 | A | 11/1973 | McCarthy | |
| 4,759,540 | A | 7/1988 | Yu | |
| 4,798,378 | A | 1/1989 | Jones | |
| 5,066,005 | A | 11/1991 | Luecke | |
| 5,263,913 | A | 11/1993 | Boren | |
| D362,700 | S | 9/1995 | Breibart | |
| D382,319 | S | 8/1997 | Gerschefske | |
| 5,681,249 | A | 10/1997 | Endelman | |
| 5,885,197 | A | 3/1999 | Barton | |
| 5,967,955 | A | 10/1999 | Westfall | |
| 6,179,753 | B1 | 1/2001 | Barker | |
| 7,163,500 | B2 | 1/2007 | Endelman | |
| 7,803,095 | B1 | 9/2010 | Lagree | |
| 7,931,570 | B2 | 4/2011 | Hoffman | |
| 8,249,714 | B1 | 8/2012 | Hartman | |
| 8,585,554 | B2 | 11/2013 | Shavit | |
| 9,597,545 | B1 | 3/2017 | Lagree | |
| 10,046,193 | B1 | 8/2018 | Aronson | |
| 10,843,031 | B1 | 11/2020 | Anne | |
| 2001/0056011 | A1 | 12/2001 | Endelman | |
| 2003/0119635 | A1 | 6/2003 | Arbuckle | |
| 2005/0130810 | A1 | 6/2005 | Sands | |
| 2005/0164856 | A1 | 7/2005 | Parmater | |
| 2006/0046914 | A1 | 3/2006 | Endelman | |
| 2006/0199712 | A1 | 9/2006 | Barnard | |
| 2007/0087921 | A1 | 4/2007 | Graham | |
| 2008/0070765 | A1 | 3/2008 | Brown | |
| 2008/0248935 | A1 | 10/2008 | Solow | |
| 2010/0227748 | A1 | 9/2010 | Campanaro | |
| 2011/0009249 | A1 | 1/2011 | Campanaro | |
| 2011/0143898 | A1 | 6/2011 | Trees | |
| 2011/0166002 | A1 | 7/2011 | Savsek | |
| 2011/0172069 | A1 | 7/2011 | Gerschefske | |
| 2012/0295771 | A1* | 11/2012 | LaGree | A63B 22/203 482/94 |
| 2013/0017935 | A1 | 1/2013 | Endelman | |
| 2013/0196835 | A1 | 8/2013 | Solow | |
| 2014/0011645 | A1 | 1/2014 | Johnson | |
| 2014/0100089 | A1 | 4/2014 | Kermath | |
| 2014/0121076 | A1 | 5/2014 | Lagree | |
| 2014/0121078 | A1 | 5/2014 | Lagree | |
| 2014/0121079 | A1 | 5/2014 | Lagree | |
| 2014/0141948 | A1 | 5/2014 | Aronson | |
| 2015/0024914 | A1* | 1/2015 | Lagree | A63B 21/0428 482/142 |
| 2015/0057127 | A1 | 2/2015 | Lagree | |
| 2015/0065318 | A1 | 3/2015 | Lagree | |
| 2015/0072841 | A1 | 3/2015 | Lagree | |
| 2015/0141204 | A1 | 5/2015 | Lagree | |
| 2015/0217164 | A1 | 8/2015 | Lagree | |
| 2015/0220523 | A1 | 8/2015 | Lagree | |
| 2015/0246263 | A1 | 9/2015 | Campanaro | |
| 2015/0297944 | A1 | 10/2015 | Lagree | |
| 2015/0343250 | A1 | 12/2015 | Lagree | |
| 2015/0360068 | A1 | 12/2015 | Lagree | |
| 2015/0360083 | A1 | 12/2015 | Lagree | |
| 2015/0360113 | A1 | 12/2015 | Lagree | |
| 2015/0364058 | A1 | 12/2015 | Lagree | |
| 2015/0367166 | A1 | 12/2015 | Lagree | |
| 2016/0008657 | A1 | 1/2016 | Lagree | |
| 2016/0059060 | A1 | 3/2016 | Lagree | |
| 2016/0059061 | A1 | 3/2016 | Lagree | |
| 2016/0096059 | A1 | 4/2016 | Lagree | |
| 2016/0166870 | A1 | 6/2016 | Lagree | |
| 2016/0193496 | A1 | 7/2016 | Lagree | |
| 2016/0256733 | A1 | 9/2016 | Lagree | |
| 2016/0271452 | A1 | 9/2016 | Lagree | |
| 2016/0317858 | A1 | 11/2016 | Lagree | |
| 2016/0346593 | A1 | 12/2016 | Lagree | |
| 2016/0361602 | A1 | 12/2016 | Lagree | |
| 2017/0014664 | A1 | 1/2017 | Lagree | |
| 2017/0014672 | A1 | 1/2017 | Lagree | |
| 2017/0036057 | A1 | 2/2017 | Lagree | |
| 2017/0036061 | A1 | 2/2017 | Lagree | |
| 2017/0065846 | A1 | 3/2017 | Lagree | |
| 2017/0072252 | A1 | 3/2017 | Lagree | |
| 2017/0087397 | A1 | 3/2017 | Lagree | |
| 2017/0100625 | A1 | 4/2017 | Lagree | |
| 2017/0100629 | A1 | 4/2017 | Lagree | |
| 2017/0106232 | A1 | 4/2017 | Lagree | |
| 2017/0113091 | A1 | 4/2017 | Lagree | |
| 2017/0120101 | A1 | 5/2017 | Lagree | |
| 2017/0144013 | A1 | 5/2017 | Lagree | |
| 2017/0157452 | A1 | 6/2017 | Lagree | |
| 2017/0157458 | A1 | 6/2017 | Lagree | |
| 2017/0165518 | A1 | 6/2017 | Lagree | |
| 2017/0165555 | A1 | 6/2017 | Lagree | |
| 2017/0189740 | A1 | 7/2017 | Lagree | |
| 2017/0189741 | A1 | 7/2017 | Lagree | |
| 2017/0209728 | A1 | 7/2017 | Lagree | |
| 2017/0239526 | A1 | 8/2017 | Lagree | |
| 2017/0246491 | A1 | 8/2017 | Lagree | |
| 2017/0246499 | A1 | 8/2017 | Lagree | |
| 2017/0296865 | A1 | 10/2017 | Lagree | |
| 2017/0304673 | A1 | 10/2017 | Lagree | |
| 2017/0326406 | A1 | 11/2017 | Lagree | |
| 2017/0340947 | A1 | 11/2017 | Lagree | |
| 2017/0354840 | A1 | 12/2017 | Lagree | |
| 2018/0015319 | A1 | 1/2018 | Lagree | |
| 2018/0021621 | A1 | 1/2018 | Lagree | |
| 2018/0021655 | A1 | 1/2018 | Lagree | |
| 2018/0036583 | A1 | 2/2018 | Lagree | |
| 2018/0056109 | A1 | 3/2018 | Lagree | |
| 2018/0056133 | A1 | 3/2018 | Lagree | |
| 2018/0111020 | A1 | 4/2018 | Lagree | |
| 2018/0111033 | A1* | 4/2018 | Lagree | A63B 71/00 |
| 2018/0117392 | A1 | 5/2018 | Lagree | |
| 2018/0133532 | A1 | 5/2018 | Lagree | |
| 2018/0133533 | A1 | 5/2018 | Lagree | |
| 2018/0133534 | A1 | 5/2018 | Lagree | |
| 2018/0133542 | A1 | 5/2018 | Lagree | |
| 2018/0178053 | A1* | 6/2018 | Lagree | A63B 21/4027 |
| 2018/0193691 | A1 | 7/2018 | Lagree | |
| 2018/0250551 | A1 | 9/2018 | Lagree | |
| 2018/0250573 | A1 | 9/2018 | Lagree | |
| 2018/0272179 | A1 | 9/2018 | Lagree | |
| 2018/0280782 | A1 | 10/2018 | Lagree | |
| 2018/0318627 | A1 | 11/2018 | Lagree | |
| 2018/0318646 | A1 | 11/2018 | Lagree | |
| 2018/0326252 | A1 | 11/2018 | Lagree | |
| 2018/0353803 | A1 | 12/2018 | Lagree | |
| 2018/0361190 | A1 | 12/2018 | Lagree | |
| 2018/0361197 | A1 | 12/2018 | Lagree | |
| 2019/0083842 | A1 | 3/2019 | Lagree | |
| 2019/0160320 | A1 | 5/2019 | Lagree | |
| 2019/0160329 | A1* | 5/2019 | Lagree | A63B 21/4035 |
| 2019/0232105 | A1 | 8/2019 | Lagree | |
| 2019/0240530 | A1 | 8/2019 | Lagree | |
| 2019/0247694 | A1 | 8/2019 | Lagree | |
| 2019/0247705 | A1 | 8/2019 | Lagree | |
| 2019/0247707 | A1 | 8/2019 | Lagree | |
| 2019/0255375 | A1 | 8/2019 | Lagree | |
| 2019/0269961 | A1 | 9/2019 | Lagree | |
| 2019/0314672 | A1 | 10/2019 | Lagree | |
| 2019/0358484 | A1 | 11/2019 | Lagree | |
| 2020/0030657 | A1 | 1/2020 | Lagree | |
| 2020/0047051 | A1* | 2/2020 | Lagree | A63B 22/0023 |
| 2020/0054913 | A1* | 2/2020 | Lagree | A63B 22/0087 |
| 2020/0078630 | A1 | 3/2020 | Lagree | |
| 2020/0078634 | A1 | 3/2020 | Lagree | |
| 2020/0171337 | A1 | 6/2020 | Lagree | |
| 2020/0188720 | A1* | 6/2020 | Villency | A63B 21/4034 |
| 2020/0188737 | A1 | 6/2020 | Villency | |
| 2020/0222741 | A1* | 7/2020 | Aronson | A63B 21/00069 |
| 2020/0353306 | A1 | 11/2020 | Lagree | |
| 2020/0376326 | A1* | 12/2020 | Lagree | A63B 22/0087 |
| 2020/0376359 | A1 | 12/2020 | Lagree | |
| 2021/0220694 | A1* | 7/2021 | Lagree | A63B 22/203 |

(56) References Cited

U.S. PATENT DOCUMENTS

| | | | | |
|---|---|---|---|---|
| 2021/0402253 | A1* | 12/2021 | Lagree | A63B 23/03541 |
| 2022/0062697 | A1* | 3/2022 | Lagree | A63B 21/4035 |
| 2022/0387845 | A1* | 12/2022 | Bentivoglio | A63B 21/00065 |

* cited by examiner

EXERCISE MACHINE HANDLE SYSTEM

CROSS REFERENCE TO RELATED APPLICATIONS

The present application is a continuation of U.S. application Ser. No. 17/144,771 filed on Jan. 8, 2021 which issues Sep. 6, 2022 as U.S. Pat. No. 11,433,272, which claims priority to U.S. Provisional Application No. 62/961,780 filed Jan. 16, 2020. Each of the aforementioned patent applications is herein incorporated by reference in their entirety.

STATEMENT REGARDING FEDERALLY SPONSORED RESEARCH OR DEVELOPMENT

Not applicable to this application.

BACKGROUND

Field

Example embodiments in general relate to an exercise machine handle system for providing a gripping structure which encircles or substantially encircles each of a plurality of exercise platforms and/or carriages on an exercise machine and minimizes unusable portions of the handles caused by the positioning and size of the handle support structures.

Related Art

Any discussion of the related art throughout the specification should in no way be considered as an admission that such related art is widely known or forms part of common general knowledge in the field.

The exercise field is well known. Those skilled in the art will appreciate that traditional exercise machines have long provided hand gripping handles for an exerciser to use for balance and support, or to otherwise grip during the performance of an exercise.

They will also appreciate that the position of the handles is not always optimized for the many exercisers' different body sizes, or perhaps not even provided at such locations to allow unfettered hand access to the handle structure wherever on the machine a handle may be desired for safety and stability.

SUMMARY

An example embodiment is directed to an exercise machine handle system. The exercise machine handle system includes a number of handles for use with a wide range of exercise machines. The handles are configured so as to minimize the number of connectors needed to mount the handles to the exercise machine and thus maximize the gripping surfaces available to an exerciser. The exercise machine handle system may include a perimeter handle which forms a continuous loop around an exercise carriage of the exercise machine. The exercise machine handle system may also include a front platform handle rising above a front platform pad and a back platform handle rising above a back platform pad.

There has thus been outlined, rather broadly, some of the embodiments of the exercise machine handle system in order that the detailed description thereof may be better understood, and in order that the present contribution to the art may be better appreciated. There are additional embodiments of the exercise machine handle system that will be described hereinafter and that will form the subject matter of the claims appended hereto. In this respect, before explaining at least one embodiment of the exercise machine handle system in detail, it is to be understood that the exercise machine handle system is not limited in its application to the details of construction or to the arrangements of the components set forth in the following description or illustrated in the drawings. The exercise machine handle system is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

Figure 1:
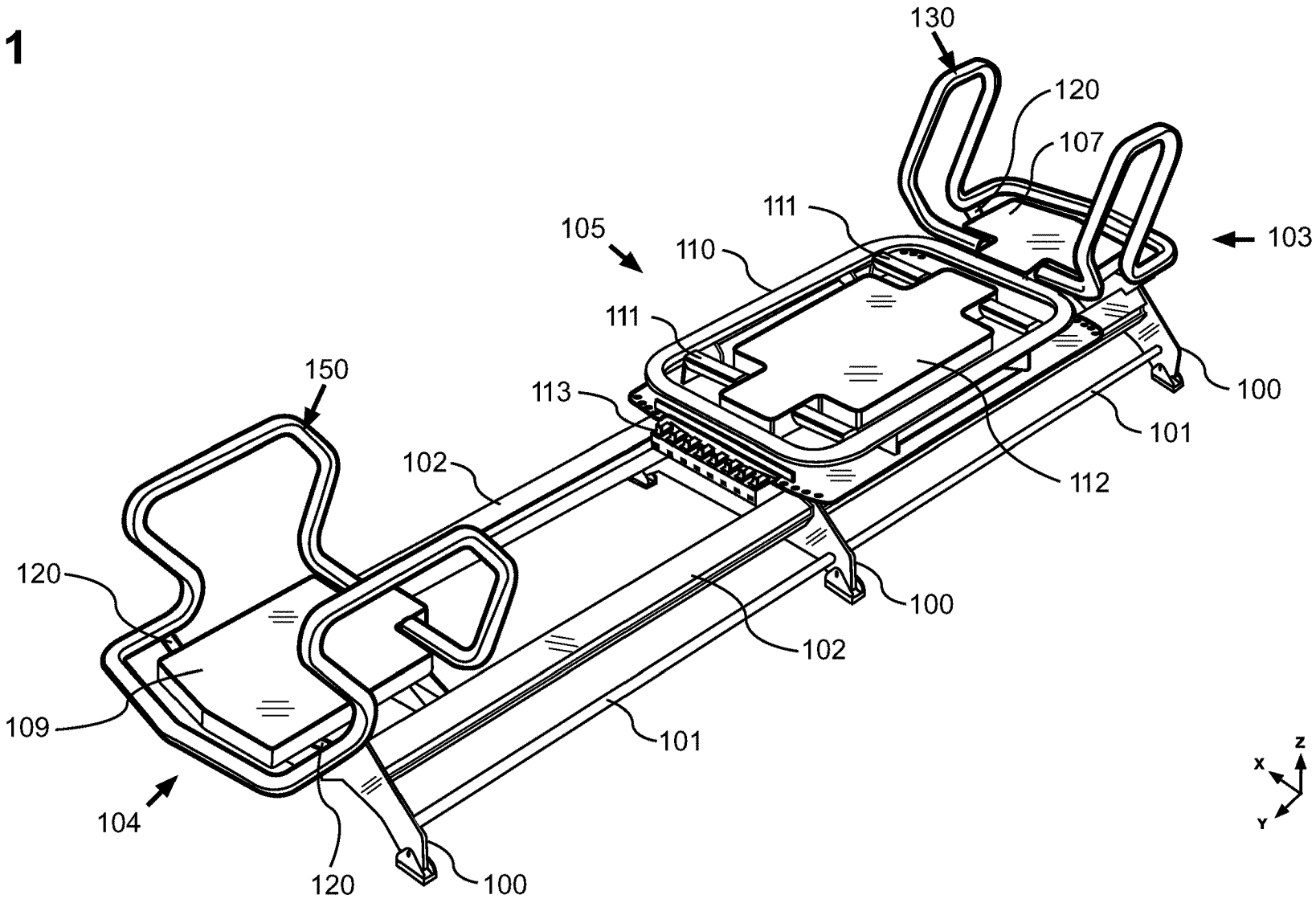
FIG. 1 is an exemplary diagram showing an isometric view of an improved exercise machine with handles in accordance with an example embodiment.

Various aspects of specific embodiments are disclosed in the following description and related drawings. Alternate embodiments may be devised without departing from the spirit or the scope of the present disclosure. Additionally, well-known elements of exemplary embodiments will not be described in detail or will be omitted so as not to obscure relevant details. Further, to facilitate an understanding of the description, a discussion of several terms used herein follows.

The word "exemplary" is used herein to mean "serving as an example, instance, or illustration." Any embodiment described herein as "exemplary" is not necessarily to be construed as preferred or advantageous over other embodiments. Likewise, the term "embodiments" is not exhaustive and does not require that all embodiments include the discussed feature, advantage or mode of operation.

The term "bar" is used herein to mean a structural member of an exercise machine or exercise equipment that is typically grasped by an exerciser during exercise. As used herein, a "bar" may be constructed of a solid material, a substantially tubular structure such as a hollow pipe of a round or rectangular cross section, the geometry of the cross section not intended to be limiting, or an assembly of a substantially rigid structure covered with a substantially resilient material. Therefore, the term "bar" is not meant to be limiting, and is used to describe any handle intended to be grasped by a user during exercise.

To provide clarity when describing certain features and functions of the substantially rectangular exercise machine, references shall be made to the X, Y and Z axes of the machine, the Y axis used to describe the longitudinal axis of the machine, the X axis uses to describe the shorter dimensioned transverse axis perpendicular to the longitudinal axis, and the Z axis used to describe dimensions or other references vertically oriented and substantially perpendicular to the horizontal plans of the floor.

Although more than one embodiment is illustrated and described herein, it will be appreciated by those of ordinary skill in the art that a wide variety of alternate and/or equivalent implementations may be substituted for the specific embodiments shown and described without departing from the scope of the present disclosure. This application is intended to cover any adaptations or variations of the embodiments discussed herein.

In an example embodiment, an exercise machine may comprise a frame such as a base support assembly 100, wherein the frame includes a first end, a second end opposite of the first end, and a longitudinal axis parallel to the ground surface. The exemplary exercise machine may include at least one guide rail 102 along which an exercise carriage 105 is movably connected so as to move or reciprocate along at least a portion of the at least one guide rail 102, which serves as a track for the exercise carriage 105. At least one resistance member 119 may be selectively connectable to the exercise carriage 105 so as to apply a resistance force against the exercise carriage 105. The exemplary exercise machine may comprise a front platform 103 at or near the first end or the second end of the frame. The exercise machine may also comprise a back platform 104 at or near the first or the second end of the frame. Each of the platforms 103, 104 may include a platform pad 107, 109 to increase comfort for an exerciser when using the platforms 103, 104.

As shown in FIGS. 1-4 and 8, the exercise machine 105 may include a perimeter handle 110 which extends around the exercise carriage 105. The figures illustrate an exemplary embodiment in which the perimeter handle 110 forms a continuous loop around the exercise carriage 105. It should be appreciated that, in some embodiments, the perimeter handle 110 may only cover a portion of the outer edges of the exercise carriage 105.

In the exemplary embodiment shown in the figures, the perimeter handle 110 comprises a first side, a second side, a first end, and a second end. The first side of the perimeter handle 110 may extend along and be distally-spaced with respect to a first side of the carriage 105. The second side of the perimeter handle 110 may extend along and be distally-spaced with respect to a second side of the carriage 105. The first end of the perimeter handle 110 may extend along and be distally-spaced with respect to the first end of the carriage 105. The second end of the perimeter handle 110 may extend along and be distally-spaced with respect to the second end of the carriage 105.

Figure 8:
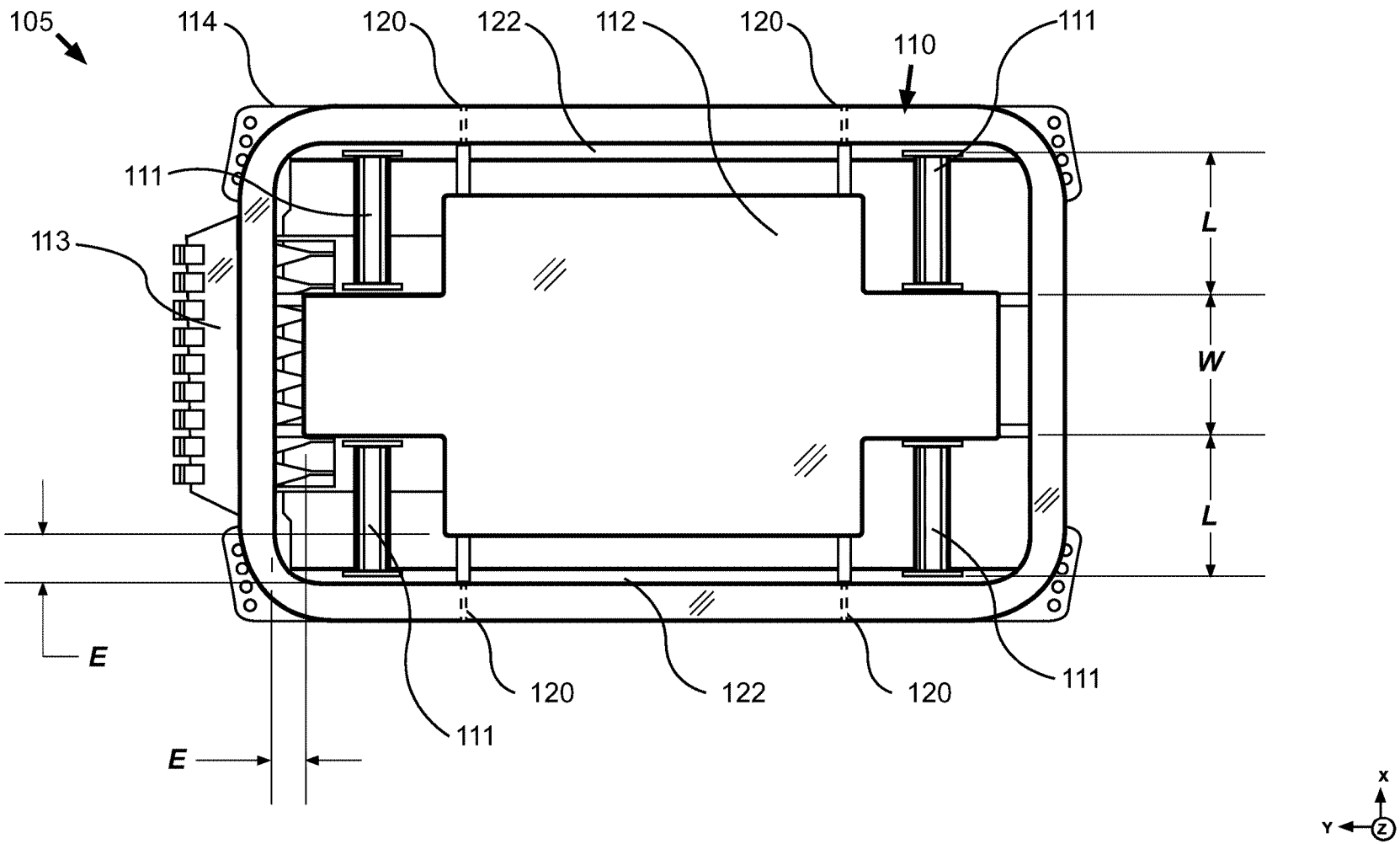
FIG. 8 is an exemplary diagram showing a top view of a reciprocating exercise platform in accordance with an example embodiment.

In the exemplary embodiment shown in FIG. 8, the perimeter handle 110 is illustrated as comprising a substantially rectangular configuration with four curved corners. The use of curvature for the corners of the perimeter handle 110 aids with gripping when the perimeter handle 110 is in use. However, it should be appreciated that the corners of the perimeter handle 110 may not be curved in some embodiments.

As can be seen, the perimeter handle 110 may completely surround the exercise carriage 105, with the entirety of the exercise carriage 105 being within the outer profile of the perimeter handle 110 when viewed from above. In some embodiments, portions of the exercise machine 105 may extend outwardly with respect to the exercise carriage 105.

The perimeter handle 110 may be distally spaced with respect to the exercise carriage 105 so as to form a space between the outer edges of the exercise carriage 105 and the perimeter handle 110. Similarly, the perimeter handle 110 may be distally spaced with respect to the underlying frame of the exercise machine so as to form a space between the lower end of the perimeter handle 110 and any structural elements of the exercise machine such as but not limited to the frame or rail(s) 102. In this manner, an exerciser will be able to grasp around the perimeter handle 110.

As best shown in FIG. 8, additional handles 111 may be provided which are connected to the exercise carriage 105. These additional handles 111 may comprise transverse handles 111 which extend between the exercise carriage 105 and the perimeter handle 110 such as shown in FIG. 8. The transverse handles 111 may be oriented perpendicular to the direction of travel of the exercise carriage 105 along the rail.

In the embodiment shown in FIG. 8, the transverse handles 111 are perpendicular with respect to the sides of the perimeter handle 111 and parallel with respect to the ends of the perimeter handle 111. The transverse handles 111 may be connected directly to the perimeter handle 111 or may be connected to a structural element of the exercise machine itself.

The perimeter handle 110 may be connected to the exercise carriage 105 by one or more connectors 120. The number, orientation, and positioning of the connectors 120 may vary in different embodiments. In the exemplary embodiment shown in FIG. 8, it can be seen that only four connectors 120 are utilized to connect the perimeter handle 110 around the exercise carriage 105. Such a configuration ensures that the perimeter handle 110 is firmly secured to the exercise carriage 105 while maximizing the gripping surfaces available along the perimeter handle 110 for use by an exerciser.

Figure 3:
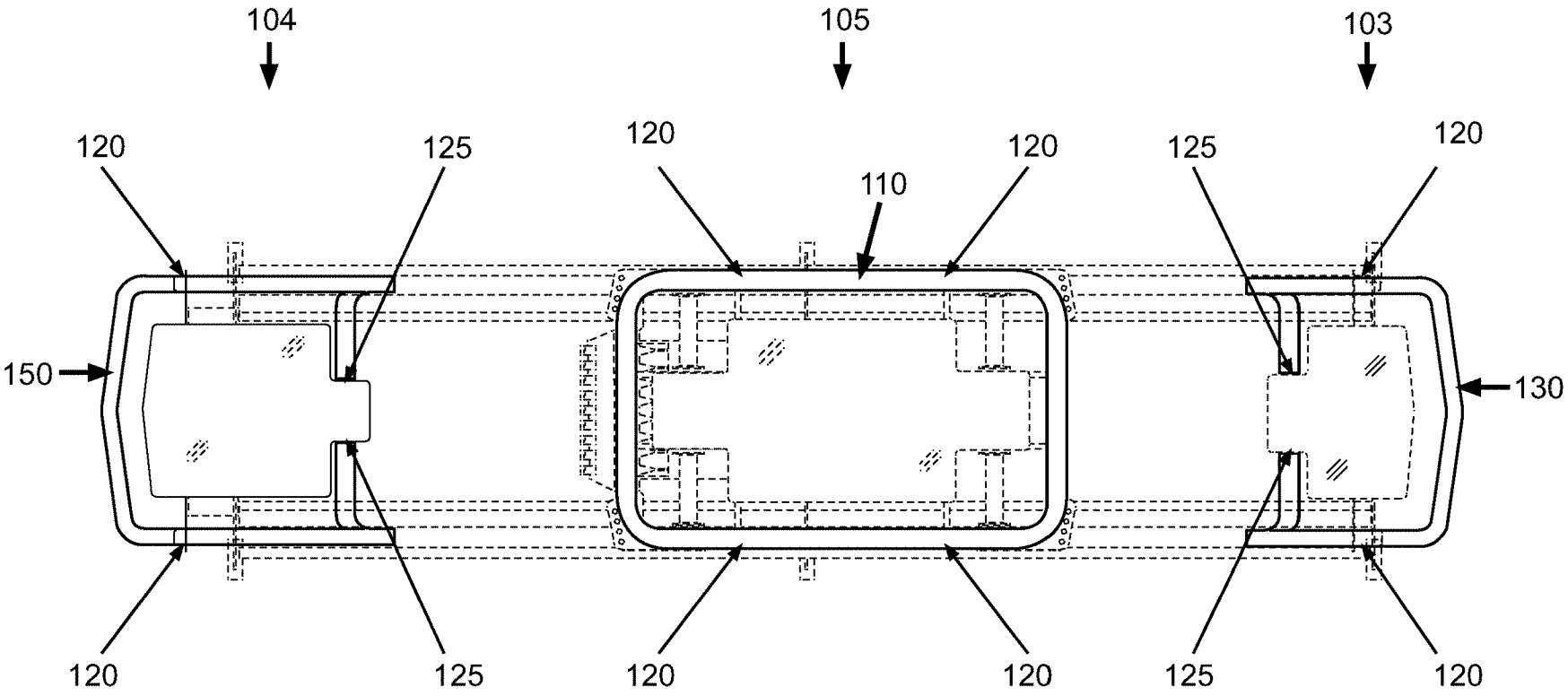
FIG. 3 is an exemplary diagram showing a top view of an improved exercise machine highlighting four exemplary locations of handle connectors on each handle in accordance with an example embodiment.

While FIG. 3 illustrates exemplary locations for the connectors 120, it should be appreciated that the connectors 120 may be positioned at other locations along the perimeter handle 110. In the exemplary embodiment shown in the figures, each of the connectors 120 are connected between the outer sides of the exercise carriage 105 and the inner sides of the perimeter handle 110.

The orientation of the connectors 120 between the perimeter handle 110 and the exercise carriage 105 may also vary in different embodiments. For example, the connectors 120 may be horizontally, diagonally, or vertically oriented to connect the exercise carriage 105 and the perimeter handle 110. The number of connectors 120 used may also vary and will depend on the shape and size of the exercise carriage 105. For example, a triangular-shaped exercise carriage 105 may use three connectors 120 instead of the four connectors 120 shown in the exemplary figures with a substantially rectangular exercise carriage 105.

As shown in FIGS. 1-5, the exercise machine may include a front platform handle 130 which is positioned at or near the front end of the exercise machine. The front platform handle 130 may be connected directly to a structural element of the exercise machine, such as its frame, or may be connected directly to the front platform 103 of the exercise machine. The front platform handle 130 may substantially (fully or partially) surround the front platform 103 such as shown in FIGS. 1-5.

The shape, size, and configuration of the front platform handle 130 may vary in different embodiments. In the exemplary embodiment shown in FIGS. 1-5 and 17-19, the front platform handle 130 is illustrated as comprising a pair of side portions 131, 135 which extend upwardly to an elevation which is distally-spaced with respect to the front platform 103. As illustrated, an exemplary embodiment of the front platform handle 130 may comprise a first side portion 131 extending along and above the first side of the front platform 103 and a second portion 135 extending along and above the second side of the front platform 103.

The side portions 131, 135 of the front platform handle 130 may comprise an inverted U-shaped design such as shown in the figures. As shown, the first side portion 131 of the front platform handle 130 may include a pair of rising members 132*a*, 132*b* which extend upwardly from the upper surface of the front platform 103. The rising members 132*a*, 132*b* of the first side portion 131 of the front platform handle 130 may extend vertically upwardly or may be diagonally-angled such as shown in the figures. In the figures, both of the rising members 132*a*, 132*b* of the first side portion 131 are shown as angled towards the front of the exercise machine.

As can be seen, a cross member 133 extends horizontally or substantially horizontally across the distal ends of the rising members 132*a*, 132*b* of the first side portion 131 so as to connect the rising members 132*a*, 132*b*. As shown in the figures, the rising members 132*a*, 132*b* and cross member 133 may be integrally formed of a unitary structure, though in alternate embodiments multiple interconnected pieces may be utilized. The cross member 133 may be elevated with respect to the front platform 103.

Figure 18:
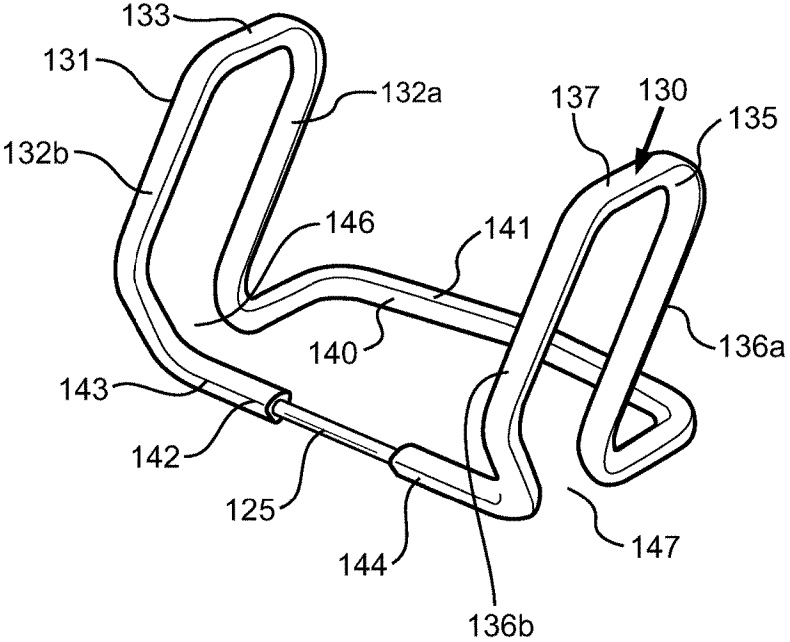
FIG. 18 is an exemplary diagram showing a perspective view of a front platform handle in accordance with an example embodiment.

As shown in FIG. 18, the second side portion 135 may be a mirror of the first side portion 131. The second side portion 135 may thus include a pair of rising members 136*a*, 136*b* which extend upwardly from the upper surface of the front platform 103 on a side of the front platform 103 opposite to the first side portion 131. The rising members 136*a*, 136*b* of the second side portion 135 of the front platform handle 130 may extend vertically upwardly or may be diagonally-angled such as shown in the figures. In the figures, both of the rising members 136*a*, 136*b* of the second side portion 135 are shown as angled towards the front of the exercise machine.

Similar to the first side portion 131, a cross member 137 extends horizontally or substantially horizontally across the distal ends of the rising members 136*a*, 136*b* of the second side portion 135 so as to connect the rising members 136*a*, 136*b*. As shown in the figures, the rising members 136*a*, 136*b* and cross member 133 may be integrally formed of a unitary structure, though in alternate embodiments multiple interconnected pieces may be utilized.

Figure 2A:
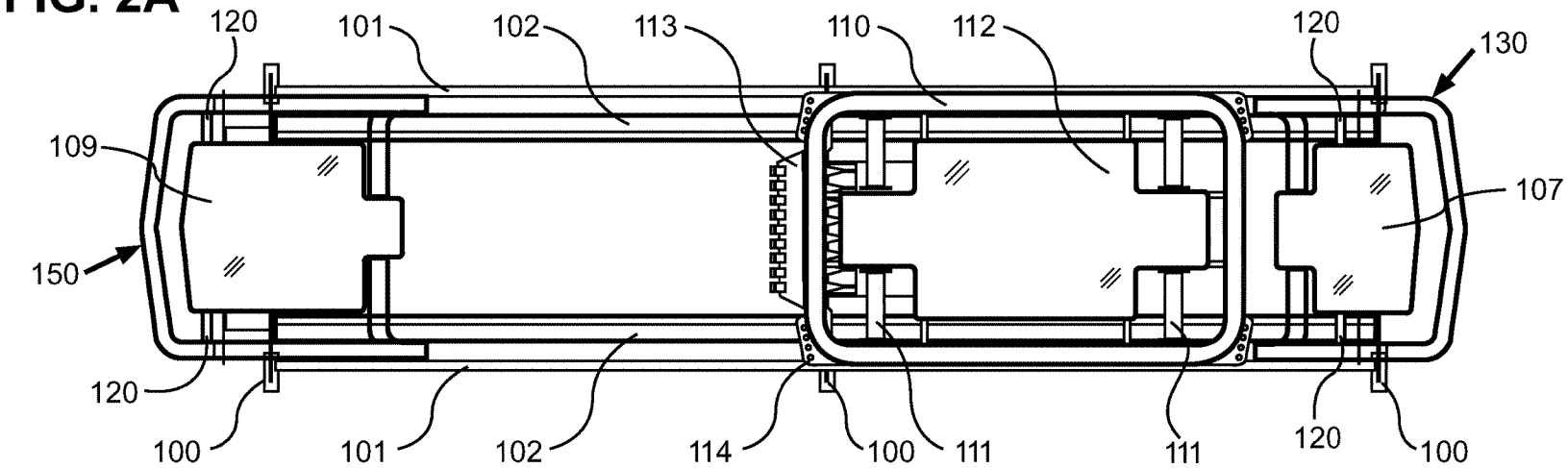
FIG. 2A is an exemplary diagram showing a top view of an improved exercise machine with handles in accordance with an example embodiment.
Figure 2B:
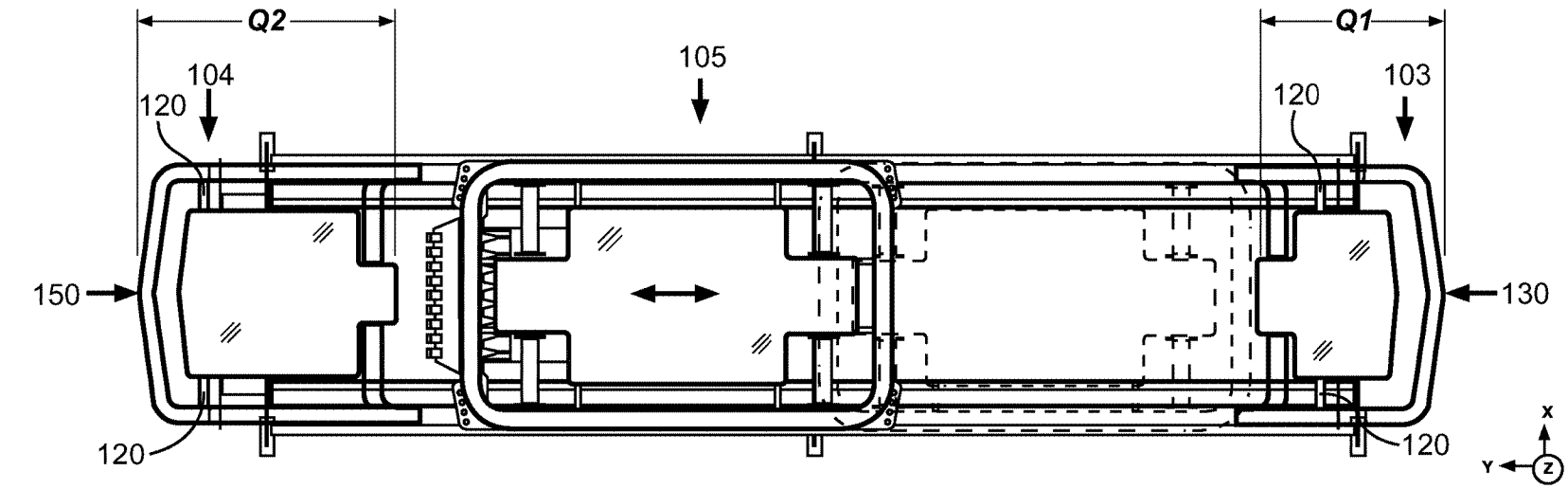
FIG. 2B is an exemplary diagram showing a top view of an improved exercise machine with handles with a movable carriage repositioned in accordance with an example embodiment.
Figure 17:
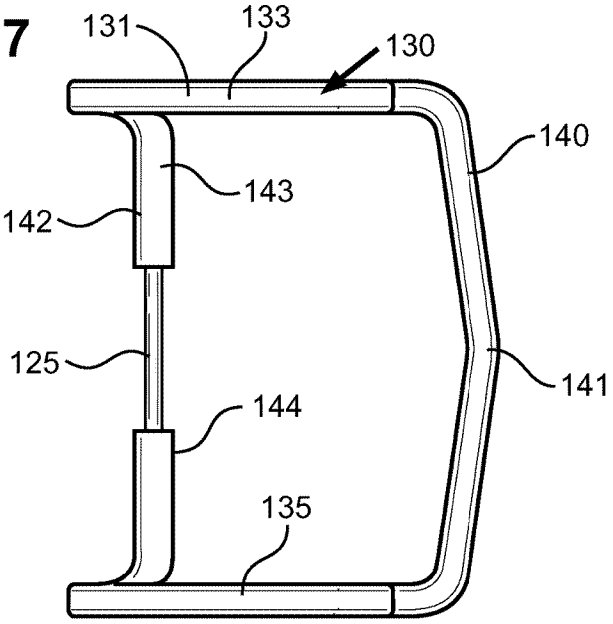
FIG. 17 is an exemplary diagram showing a top view of a front platform handle in accordance with an example embodiment.
Figure 19:
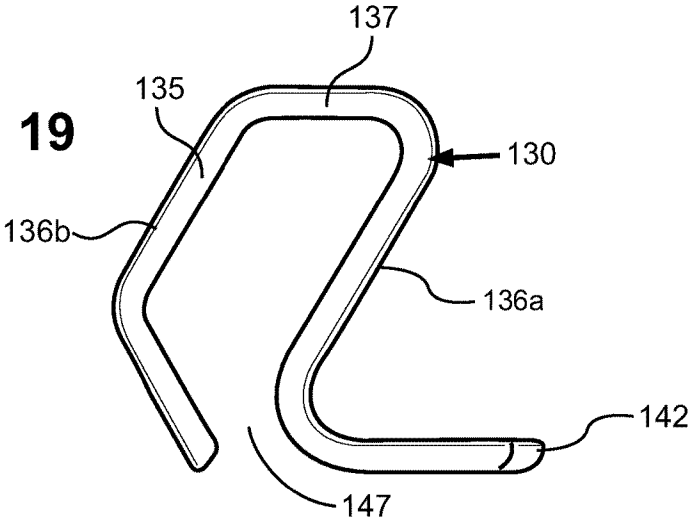
FIG. 19 is an exemplary diagram showing a side view of a front platform handle in accordance with an example embodiment.

As shown in FIGS. 17-19, the front platform handle 130 may also comprise a front portion 140 comprising a cross member 141 that extends transverse to a longitudinal axis extending along the path of travel of the carriage 105. The front portion 140 extends between the first side portion 131 and the second side portion 135 of the front platform handle 130. The front portion 140 of the front platform handle 130 may be cantilevered such as shown in FIGS. 1, 2A, and 2B. The front portion 140 including the cross member 141 may be integrally formed with the side portions 131, 135 or may comprise different interconnected structures.

The front platform handle 130 may also comprise a back portion 142 comprising a pair of connector ends 143, 144 which are connected to the exercise machine, such as the frame, or to the front platform 103 such as in the embodiment shown in FIG. 1. Each connector end 143, 144 may include an end connector 125 which is connected to the exercise machine, such as the frame, or the front platform 103. The end connectors 125 may be adapted to engage with a corresponding receiver such as an opening in the exercise machine, such as the frame, or in the front platform 103, with the receiver being adapted to frictionally, threadably, or otherwise engage with the end connector 125.

As shown in FIGS. 1-5 and 14-16, the exercise machine may include a back platform handle 150 which is positioned at or near the back end of the exercise machine. The cross member 137 may be elevated with respect to the front platform 103. The back platform handle 150 may be connected directly to a structural element of the exercise machine, such as its frame, or may be connected directly to the back platform 104 of the exercise machine. The back platform handle 150 may substantially (fully or partially) surround the back platform 104 such as shown in FIGS. 1-5.

The shape, size, and configuration of the back platform handle 150 may vary in different embodiments. In the exemplary embodiment shown in FIGS. 14-16, the back platform handle 150 is illustrated as comprising a pair of side portions 151, 155 which extend upwardly to an elevation which is distally-spaced with respect to the back platform 104. As illustrated, an exemplary embodiment of the back platform handle 150 may comprise a first side portion 151 extending along and above the first side of the back platform 104 and a second side portion 155 extending along and above the second side of the back platform 104.

The side portions 151, 155 of the back platform handle 150 may comprise an inverted U-shaped or substantially trapezoidal design such as shown in the figures. As shown, the first side portion 151 of the back platform handle 150 may include a pair of rising members 152*a*, 152*b* which extend upwardly from the upper surface of the back platform 104. The rising members 152*a*, 152*b* of the first side portion 151 of the back platform handle 150 may extend vertically upwardly or may be diagonally-angled such as shown in the figures.

In the figures, both of the rising members 152*a*, 152*b* of the first side portion 151 are shown as angled in different directions. The first rising member 152*a* of the first side portion 151 of the back platform handle 150 is shown as, from its lower end, first being angled toward the front of the exercise machine and then being angled toward the back of the exercise machine. The second rising member 152*b* of the first side portion 151 of the back platform handle 150 is shown as being angled toward the back of the exercise machine.

As can be seen, a cross member 153 extends horizontally or substantially horizontally across the distal ends of the rising members 152*a*, 152*b* of the first side portion 151 of the back platform handle 150 so as to connect the rising members 152*a*, 152*b*. As shown in the figures, the rising members 152*a*, 152*b* and cross member 153 may be integrally formed of a unitary structure, though in alternate embodiments multiple interconnected pieces may be utilized. The cross member 153 may be elevated with respect to the back platform 104.

Figure 15:
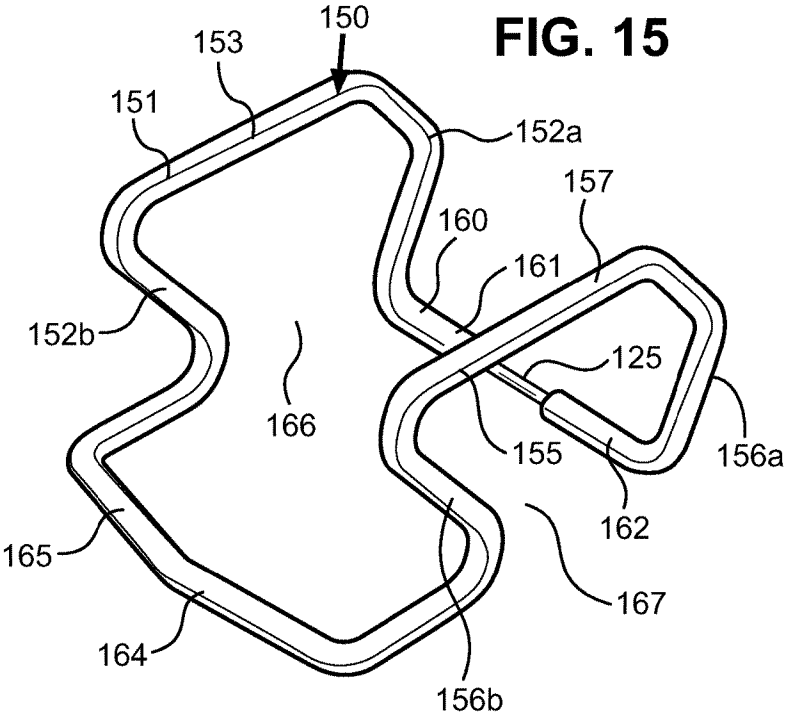
FIG. 15 is an exemplary diagram showing a perspective view of a back platform handle in accordance with an example embodiment.
Figure 14:
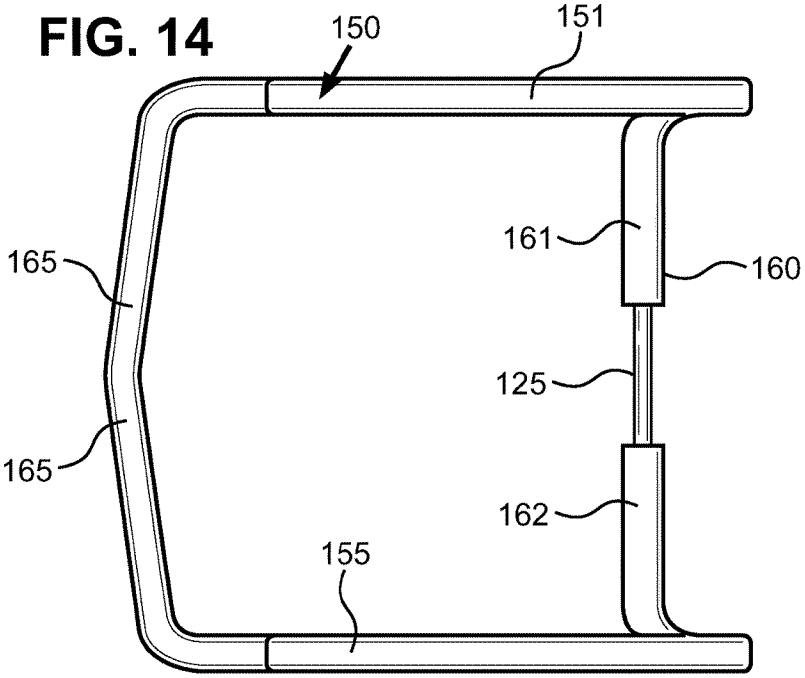
FIG. 14 is an exemplary diagram showing a top view of a back platform handle in accordance with an example embodiment.
Figure 16:
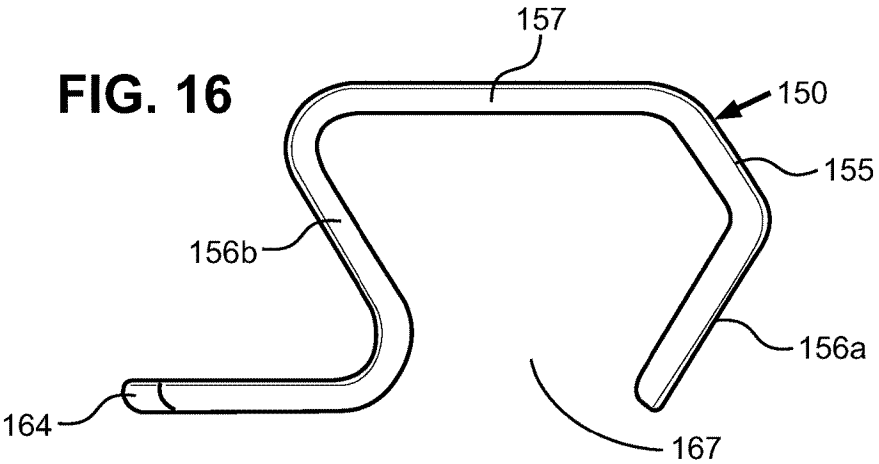
FIG. 16 is an exemplary diagram showing a side view of a back platform handle in accordance with an example embodiment.

As shown in FIGS. 14-16, the second side portion 155 of the back platform handle 150 may be a mirror of the first side portion 151 of the back platform handle 150. The second side portion 155 may thus include a pair of rising members 156*a*, 156*b* which extend upwardly from the upper surface of the back platform 104 on a side of the back platform 104 opposite to the first side portion 151. The rising members 156*a*, 156*b* of the second side portion 155 of the back platform handle 150 may extend vertically upwardly or may be diagonally-angled such as shown in the figures.

In the figures, both of the rising members 156*a*, 156*b* of the second side portion 155 are shown as angled in different directions. As shown in FIG. 16, the first rising member 156*a* of the second side portion 155 of the back platform handle 150 is shown as, from its lower end, first being angled toward the front of the exercise machine and then being angled toward the back of the exercise machine. The second rising member 156*b* of the second side portion 155 of the back platform handle 150 is shown as being angled toward the back of the exercise machine.

Similar to the first side portion 151, a cross member 157 extends horizontally or substantially horizontally across the distal ends of the rising members 156*a*, 156*b* of the second side portion 155 so as to connect the rising members 156*a*, 156*b*. As shown in the figures, the rising members 156*a*, 156*b* and cross member 153 may be integrally formed of a unitary structure, though in alternate embodiments multiple interconnected pieces may be utilized. The cross member 157 may be elevated with respect to the back platform 104.

As shown in FIGS. 14-16, the back platform handle 150 may also comprise a back portion 164 comprising a cross member 165 that extends transverse to a longitudinal axis extending along the path of travel of the carriage 105. The back portion 164 extends between the first side portion 151 and the second side portion 155 of the back platform handle 150. The back portion 164 of the back platform handle 150 may be cantilevered such as shown in FIGS. 1, 2A, and 2B. The back portion 164 including the cross member 165 may be integrally formed with the side portions 151, 155 or may comprise different interconnected structures.

The back platform handle 150 may also comprise a front portion 160 comprising a pair of connector ends 161, 162 which are connected to the exercise machine, such as the frame, or to the back platform 104 such as in the embodiment shown in FIG. 1. Each connector end 161, 162 may include an end connector 125 which is connected to the exercise machine, such as the frame, or the back platform 104. The end connectors 125 may be adapted to engage with a corresponding receiver such as an opening in the exercise machine, such as the frame, or in the back platform 104, with the receiver being adapted to frictionally, threadably, or otherwise engage with the end connector 125.

FIG. 1 is an exemplary diagram showing an isometric view of an improved exercise machine handle system. An exemplary exercise machine, such as a resistance training machine, may be comprised of a frame which includes a plurality of base support assemblies 100, each with a substantially vertically projecting member and a plurality of feet affixed to the lower end that rest on a floor. The frame may also include a plurality of tie rods 101 aligned with the Y axis so as to increase the structural rigidity of the frame by extending between and affixed to the vertical portions of the base support assemblies 100 of the frame. Further, two parallel guide rails 102 aligned with the Y axis extend substantially the length of the machine between the distally opposed base support assemblies 100, the guide rails 102 providing for tracks upon which the wheels of a moveable exercise carriage 105 may roll. It should be appreciated that, in some embodiments, a single rail 102 such as a monorail may be utilized.

A front platform 103, providing for a first stationary support structure for an exerciser, is affixed to the front end of the machine, such as to the frame of the machine, the front platform 103 comprising at least a front platform handle 130 and a front platform pad 107.

A back platform 104 providing for a second stationary support structure for an exerciser, is affixed to the back end of the machine, such as to the frame of the machine, the back platform 104 comprising at least a back platform handle 150 and a back platform pad 109. In the drawing, one connector 120 providing one attachment point between the back platform handle 150 and the back platform structure 104 can be seen, although a mirror image of the connector 120 is similarly positioned on the opposed side of the machine but is obscured by the right side back handle in this view.

The exercise carriage 105 comprises a perimeter handle 110 encircling and spaced apart from the carriage pad 112, and a plurality of handles 111 with the central axes aligned with the X axis of the machine. In practice, and in response to a force being applied to the exercise carriage 105 by the exerciser, the exercise carriage 105 will move substantially between the front platform 103 and the back platform 104 along the guide rails 102. The default position for the exercise carriage 105 is proximate to the front end of the machine, such as proximate to the front platform 103, biased to return to that position by one or more resistance members 119 affixed between the stationary exercise machine structure, such as the frame of the machine, and the exercise carriage 105. A resistance switch console 113 allows an exerciser to engage or disengage any number of available resistance members 119 to increase or decrease the resistance bias exerted upon the exercise carriage 105 as may be preferred by the exerciser for performing any one or more exercises.

FIG. 2A is an exemplary diagram showing a top view of an improved exercise machine handle system with a stationary support structure comprising a frame including a plurality of base support assemblies 100, a plurality of tie rods 101, a pair of parallel guide rails 102, a stationary front platform handle 130 and front exercise pad 107, a stationary back platform handle 150 and back platform pad 109. An exercise carriage is movable along the Y axis as previously described comprising a perimeter handle 110, carriage pad 112, a plurality of transverse handles 111 and a resistance switch console 113.

FIG. 2B is an exemplary diagram showing a top view of an improved exercise machine handle system with a movable carriage 105 repositioned. As indicated by the double headed arrow on the carriage, the exercise carriage 105 reciprocates along the Y axis distally from a default position proximate to the stationary front platform 103 to a position proximate the stationary back platform 104. The default position of the exercise carriage 105 is shown in the illustration as a dashed carriage outline.

It should be noted that the length dimension Q1 of the front platform 103 measured along the Y axis is less than the length dimension Q2 of the back platform 104 measured along the Y axis. The front platform 103 is used by an exerciser to push against while moving the exercise carriage 105 in a direction towards the back platform 104, while the back platform 104 is used by an exerciser thereupon to pull the exercise carriage 105 in a direction towards the back platform 104 with sufficient force to overcome the resistance members removably attached to the exercise carriage 105. The smaller dimension of the front platform 103 provides for a minimized overall length of the exercise machine, while the longer length of the back platform 104 provides more exerciser support surface area as may be required to help anchor the exerciser to the back platform 104 when performing exercises from the back end of the machine.

FIG. 3 is an exemplary diagram showing a top view of an improved exercise machine highlighting four preferred approximate locations of handle connectors 120, 125 supporting each handle 110, 130, 150. It should be appreciated, however, that the exemplary arrangement shown in FIG. 3 is merely for exemplary purposes, and should not be construed as limiting in scope.

Exercise instructors appreciate that exercisers come in all body sizes and shapes, and that each has unique physical capabilities and limitations. Each exerciser therefore requires the ability to quickly and conveniently grasp the closest, most accessible portion of a handle 110, 130, 150 for added stability during exercise performance. One object of the exercise machine handle system is to maximize hand-gripping surfaces as preferred by any exerciser.

It is well known that a handle 110, 130, 150 may be attached to a structure. The use of more handles 110, 130, 150 necessitates additional attachment points, and each attachment point thereby renders a portion of the handle 110, 130, 150 structure unusable as a gripping surface.

As can be readily appreciated in the illustration, the main machine structure is shown as a dotted outline so as to allow the attention to be directed toward the three primary handles.

The front platform 103 is shown with a continuous front platform handle 130 substantially encircling the front platform 103. The continuous front platform handle 130 is shown affixed to the front platform 103 in only four locations, the connector ends 143, 144 affixed to the end connectors 125 of the front platform 103 structure, and affixed to two connectors 120, thereby minimizing the under-handle supports that would otherwise eliminate a portion of the front platform handle 130 as effective gripping surfaces.

Similarly, the back platform 104 is shown with a continuous back platform handle 150 substantially encircling the back platform 104. The continuous back platform handle 150 is shown affixed to the back platform 104 in only four locations, the connector ends 161, 162 affixed to the end connectors 125 of the back platform 150 structure, and affixed to two connectors 120, thereby minimizing the under-handle supports that eliminate a portion of the back platform handle 150 as effective gripping surfaces.

Further, the exercise carriage 105 is shown with a continuous perimeter handle 110 encircling the entire carriage structure, the perimeter handle 110 being affixed to the carriage structure by only four connectors 120, thus minimizing the number and size of under-handle supports that would otherwise eliminate portions of the carriage handle 110 as effective gripping surfaces.

Figure 4A:
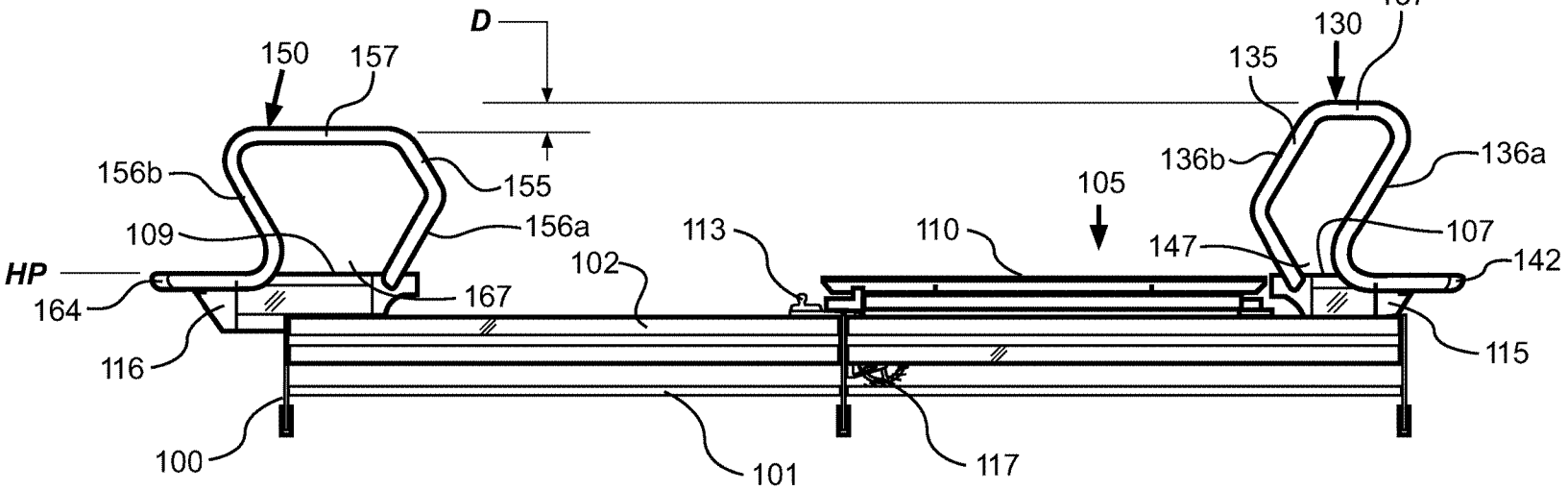
FIG. 4A is an exemplary diagram showing a side view of an improved exercise machine with handles in accordance with an example embodiment.

FIG. 4A is an exemplary diagram showing a right side view of an improved exercise machine handle system. An exercise machine comprises a plurality of tie rods 101 and guide rails 102 aligned with the Y axis and affixed to a plurality of base support assemblies 100. A front platform structure 115 is affixed at the front end of the machine structure, such as to the front of the frame of the machine, the assembly comprising a front platform handle 130 and front platform pad 107. The geometry of the right side of the continuous front platform handle 130 is shown formed with a loop extending upwardly from the horizontal X-Y plane HP of the exercise platforms 103, 104, then returning downwardly substantially back to the horizontal X-Y plane HP.

A back platform structure 116 is affixed at the back end of the machine structure, such as near the back end of the frame, the back platform structure 116 comprising a back platform handle 150 and back platform pad 109. The geometry of the right side of the continuous back platform handle 150 is shown formed with a loop extending upwardly from the horizontal plane HP of the exercise platforms, then returning downwardly substantially back to the HP.

A reciprocating exercise carriage 105 comprises a carriage handle 110 with the top surface of the carriage handle 110 substantially aligned with the HP. A resistance switch console 113 is shown affixed to the back end of the exercise carriage 105, and a portion of the resistance cassette 117 can be seen through the space between the tie rod 101 and guide rail 102.

The geometry or the front and back platform handles 130, 150 will be fully described below, but it should be noted that the uppermost portion of the front platform handle 130 when measured in the Z axis from the HP is a larger vertical dimension than the vertical dimension measured between HP and the uppermost portion of the back platform handle 150, the relative differences between the two measurements just described shown as D.

An exerciser will initiate an exercise routine by mounting the exercise carriage 105 in its default position proximate to the front platform 103 as shown in the drawing, oftentimes standing with one foot positioned on the carriage pad 112, and the other foot positioned on the front platform pad 107. In the frequently assumed standing position, an exerciser may more readily reach the left or right elevated portions of the handle 130, 150 if the uppermost portion is a preferred dimension above the HP.

On the other hand, an exerciser positioned on the exercise carriage 105 to face the back platform 103 while the exercise carriage 105 is in the default position shown must assume a posture that is substantially more horizontal in order to balance and reach with extended arms towards the back platform handle 150, rather than the vertical standing posture just described. The more lowered centerline, and correspondingly lower shoulder height of an exerciser in a substantially more horizontal posture exercising while their hands engage the back platform handle 150 will therefore appreciate the more reachable reduced vertical height top of the back platform handle 150 relative to HP when compared to the top of the increased height of the top surface of the front platform handle 130 to HP that are more easily reachable when standing.

It should be noted that it may be preferred for some exercises that the vertical dimension from HP to the top surface of the front platform handle 130 be smaller than the vertical dimension from HP to the top surface of the back platform handle 150, thereby reversing relative heights of the front and back platform handles 130, 150. Therefore, one variation of the exemplary embodiment just described is a removably attachable front and back platform 104, 103 that may be detached from the making end just described, and reattached on the opposed end of the machine as a means to provide for a higher back platform handle 150 and a relatively lower top surface of the front platform handle 130.

Figure 4B:
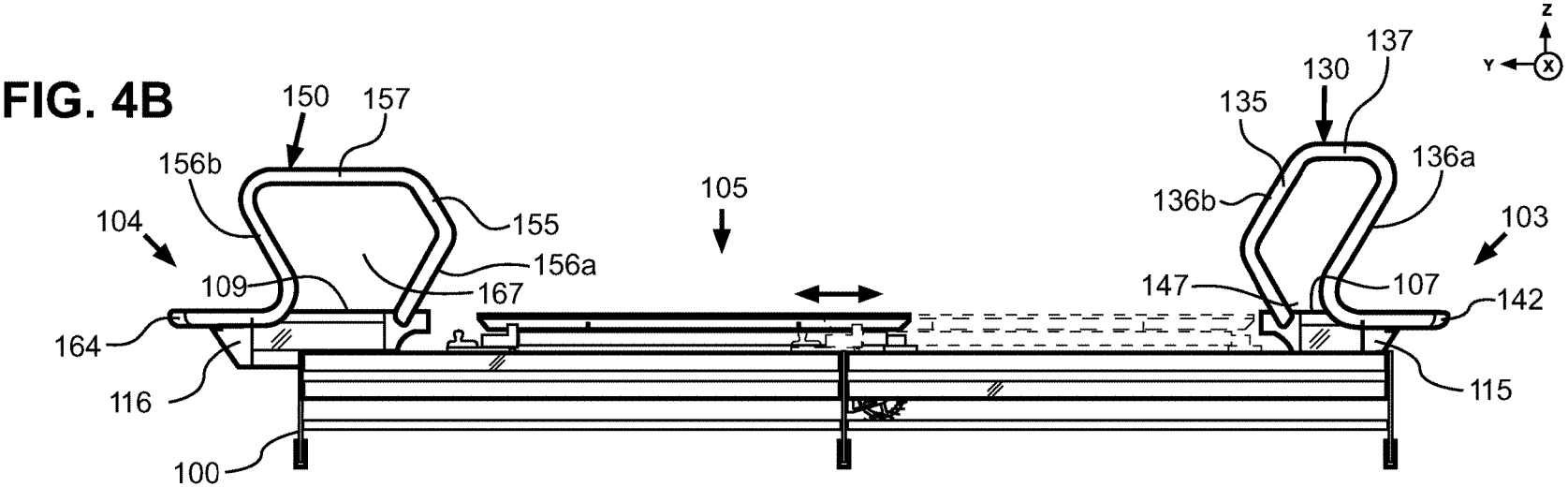
FIG. 4B is an exemplary diagram showing a side view of an improved exercise machine with handles with a movable carriage repositioned in accordance with an example embodiment.

FIG. 4B is an exemplary diagram showing a side view of an improved exercise machine handle system with a movable exercise carriage 105 repositioned. As indicated by the double headed arrow on the exercise carriage 105, the exercise carriage 105 reciprocates along the Y axis distally from a default position proximate to the stationary front platform 103 to a position proximate the stationary back platform 104. The default position of the exercise carriage 105 is shown in the illustration as a dashed carriage outline.

Figure 5:
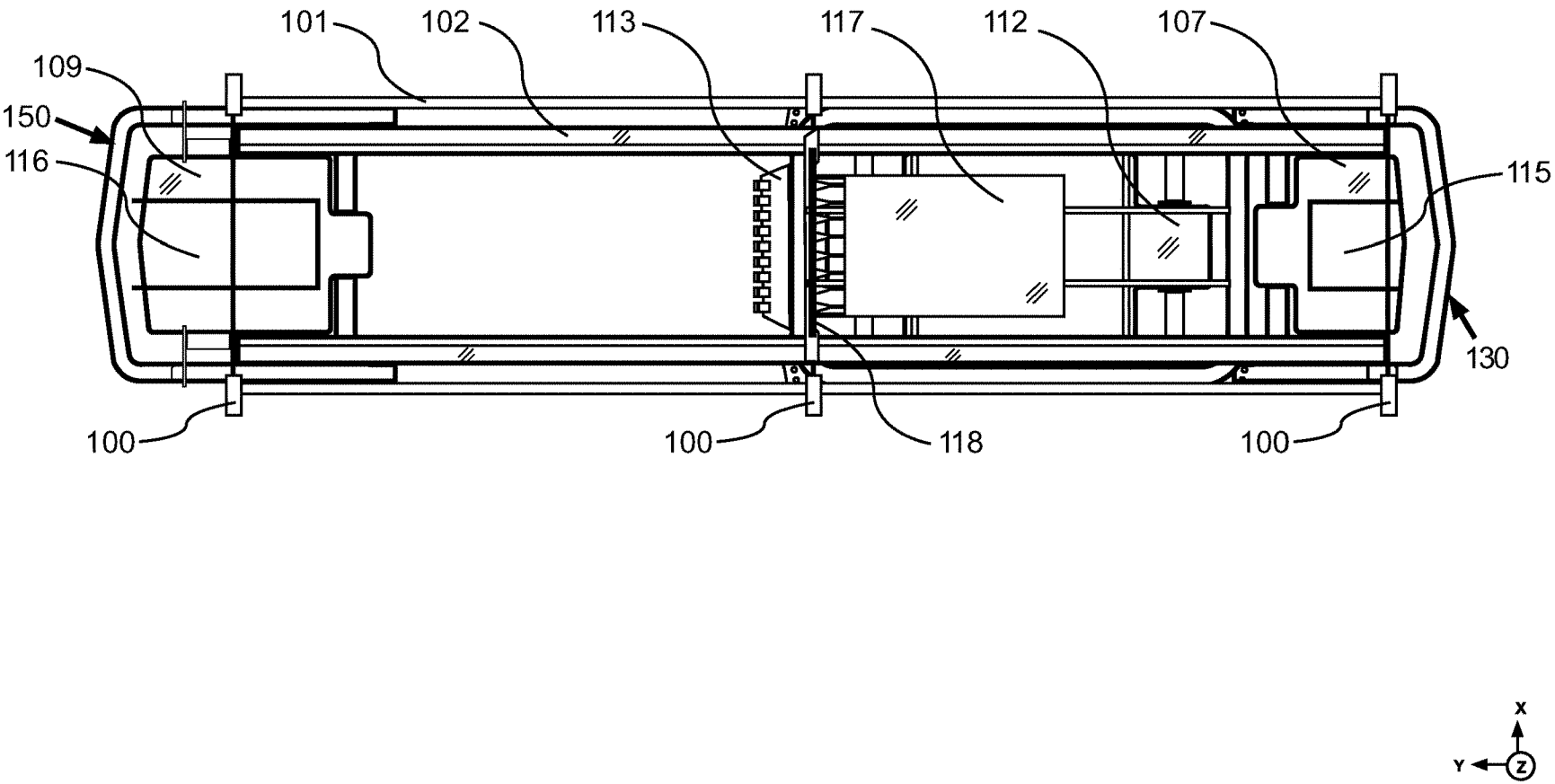
FIG. 5 is an exemplary diagram showing a bottom view of an improved exercise machine with handles in accordance with an example embodiment.

FIG. 5 is an exemplary diagram showing a bottom view of an improved exercise machine handle system. The bottoms of the feet portions of a plurality of base support assemblies 100 are shown substantially at the opposed ends and middle of the exercise machine. Tie rods 101 are affixed to and between the base support assemblies 100 for increased structural rigidity of the machine structure. Further, as previously described, a pair of parallel guide rails 102 positioned equally from the central Y axis of the machine extend substantially between the distally opposed base support members. The underside of the front platform 103 shows the bottom surface of the front platform pad 107 and front platform handle 130 affixed to the front platform structure 115 and previously described. The underside of the back platform 104 shows the bottom surface of the back platform pad 109 and back platform handle 150 affixed to the back platform structure 116 as previously described.

Further, a portion of the carriage pad 112 can be seen from the underside of an exercise carriage 105 and is obscured in part by a resistance cassette 117, the resistance cassette 117 enclosing a plurality of resistance members 119, the resistance members 119 being removably attached between a resistance anchor 118 and the resistance switch console 113 so as to increase or decrease the total resistance exerted by the resistance members upon the exercise carriage 105.

As previously discussed and which can be readily seen, the length of the back platform pad 109 as measured along the Y axis may be longer than the front platform pad 107 as measured along the same Y axis.

Figure 6:
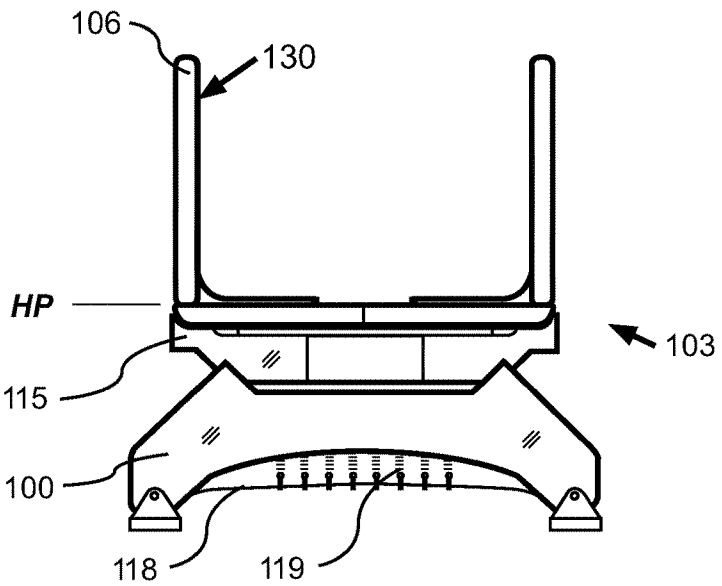
FIG. 6 is an exemplary diagram showing a front view of an improved exercise machine with handles in accordance with an example embodiment.

FIG. 6 is an exemplary diagram showing a front view of an improved exercise machine handle system. A front platform structure 115 of the front platform 103 is affixed at or near the front of the frame, such as to the front base support assembly 100. A resistance anchor 118, preferably positioned at the approximate center of the length of the Y axis of the machine, is shown distally positioned behind the front base support assembly 100. A plurality of resistance members 119 are shown, with a first end of the resistance members 119 being affixed to the resistance anchor 118 and extending upwardly towards the exercise carriage 105. The second end of the resistance members 119 are shown as removably attached to the resistance switch console 113.

A continuous front platform handle 130 is shown with a proximate forward facing portion extending laterally between the vertically projecting left and right portions of the handle 130, substantially along the X axis of the machine with the top surface of the laterally extending portion aligned with the HP of the front platform pad 107.

Figure 7:
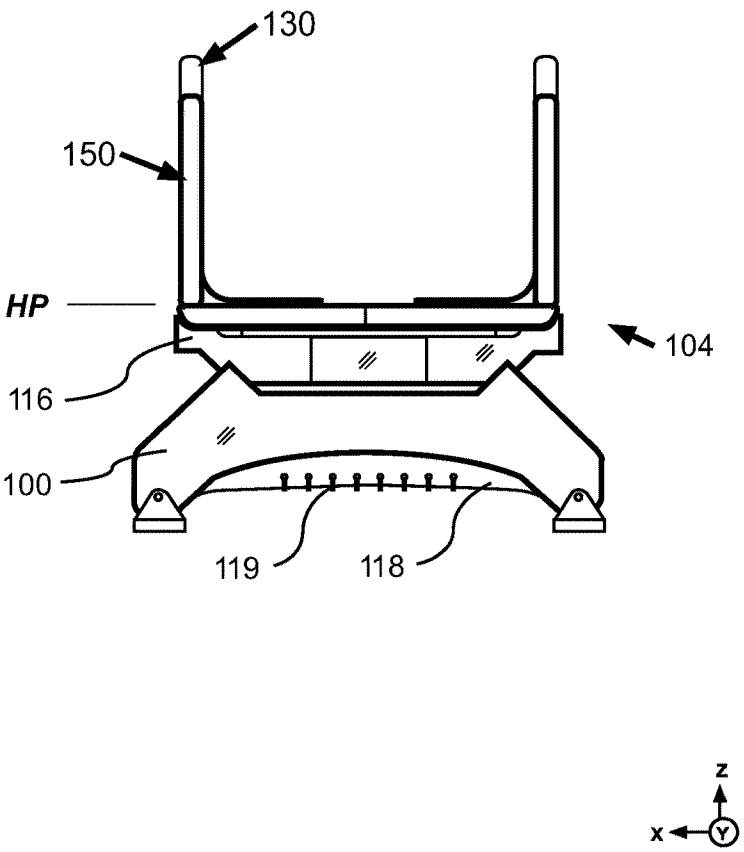
FIG. 7 is an exemplary diagram showing a back view of an improved exercise machine with handles in accordance with an example embodiment.

FIG. 7 is an exemplary diagram showing a back view of an improved exercise machine handle system. A back platform structure 116 of the back platform 104 is affixed to the back end of the base support assembly 100. A resistance anchor 118 is positioned at the approximate center of the length of the Y axis of the machine, with the resistance anchor 118 being distally positioned behind the back end of the base support assembly 100. A portion of the affixed ends of a plurality of resistance members 119 is shown projecting through to the near side of the resistance anchor 118.

A continuous back platform handle 150 is shown with a proximate backward facing portion extending laterally between the vertically projecting left and right portions of the handle 150, substantially along the X axis of the machine with the top surface of the laterally extending portion aligned with the HP of the front platform pad 107.

As can be readily seen, the top surface of the distal front platform handle 130 is positioned higher relative to the HP than the top surface of the proximate back platform handle 150 as previously described.

FIG. 8 is an exemplary diagram showing a top view of a reciprocating exercise carriage having been separated from the exercise machine so as to more clearly illustrate its features. As previously described, the exercise carriage 105 comprises a perimeter handle 110, a carriage pad 112 with a longitudinal centerline aligned with the Y axis, and a plurality of transverse handles 111 with the central axis of the transverse handles 111 substantially aligned with the X axis. A perimeter handle 110 is shown encircling but spaced apart at various dimensions from the perimeter vertical surfaces of the carriage pad 112 such that the minimum space E provides for unrestricted insertion of an exerciser's fingers and/or thumbs as may be required to grasp either the outwardly projecting edges of the carriage pad 112, and/or the perimeter handle 110 at nearly any position as may be needed by the exerciser for safety and support.

A resistance switch console 113 is shown affixed to the back end of the exercise carriage 105, though it should be appreciated that the resistance switch console 113 may be affixed to various other locations along the exercise carriage 105 in different embodiments. A plurality of attachment holes at the four corners of the accessory plate 114 and longitudinal structural member 122 of the exercise carriage 105 provide for the removable attachment of various machine accessories.

Further, the length of the plurality or transverse handles 111 is shown in the illustration as L, and the width of the front and back narrow portion of the carriage pad 112 is shown as W. In practice, the transverse handles 111 may be grasped by the hand for reciprocally pushing or pulling the exercise carriage 105 along the guide rails 102, or the exerciser may push on the transverse handles 111 with their feet by inserting the toes of the foot or feet in the space between the transverse handles 111 and the adjacent and substantially parallel edge of the carriage pad 112, or between the transverse handle 111 and the adjacent substantially parallel portion of the perimeter handle 110.

The dimension L of the transverse handles 111 may therefore be of a sufficient length to easily accommodate the widest possible foot width of an exerciser, and further to provide for easy adjustment from narrow to wide hand grip by an exerciser. Within a fixed width of the exercise carriage 105, it is therefore preferred that the length dimension of the transverse handles L are equal to or greater than the transverse width dimension W of the narrow portion of the carriage pad 112.

As previously described with respect to FIG. 3, the perimeter handle 110 may be affixed to the carriage structure by connectors 120 shown as dashed lined because they are positioned between the lower surface of and obscured by the perimeter handle, but above the longitudinal structural members 122. It is important to note that the minimum number, size and positions of the connectors 120 maximize the nearly limitless number of hand grasping positions anywhere on the perimeter handle, and further provide for a finger space between the lower surface of the handle 110 and upper surface of the longitudinal structural member.

Those skilled in the art will appreciate that the dimensional and structural description above provides for substantial improvement in the utility and functionality related to the multiple points of exerciser engagement with a reciprocating exercise carriage.

Figure 9:
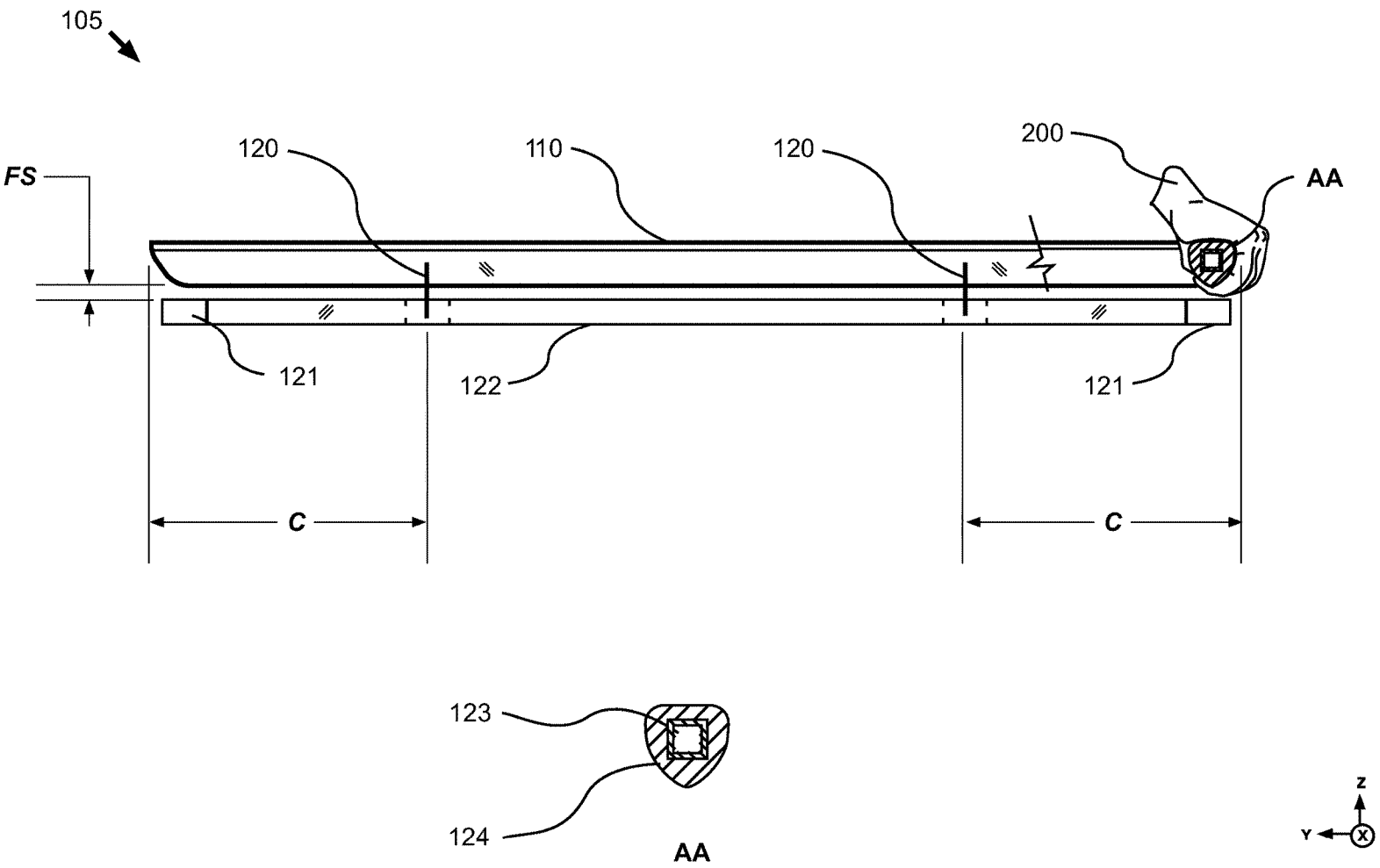
FIG. 9 is an exemplary diagram showing a side view of a reciprocating exercise platform in accordance with an example embodiment.

FIG. 9 is an exemplary diagram showing a side view of an exemplary embodiment of an exercise carriage 105 that may move or reciprocate along one or more rails 102. More specifically, the side view of a continuous perimeter handle 110 is shown with a portion of the right section cut away to illustrate the sectional view AA of the transverse portion of the perimeter handle 110 as grasped by an exerciser's hand. As just described, the perimeter handle 110 is affixed to the longitudinal structural member 122 of the exercise carriage 105 by use of a plurality of appreciably thin connectors 120 such that sufficient finger space FS is provided therebetween to allow for the fingers of the exerciser's hand 200 to wrap completely around and underneath the lower surface of the perimeter handle.

In order to minimize the number of supporting connectors 120 while maintaining cost efficiency and structural integrity, the connectors 120 may be spaced apart such that a front and back portion of the perimeter handle 110 is cantilevered a distance C forward of and behind the front and back connectors 110, respectively. Transverse structural members 121 are affixed to the front and back ends of the left and right side longitudinal structural members 122.

In the enlarged section view AA, it can be seen that the perimeter handle 110 is constructed of a substantially tubular structure such as a hollow thick-walled pipe of a round or rectangular cross section 123, covered with a substantially resilient material 124 providing for many different handle profiles including, but not limited to the substantially triangular profile as shown.

Alternatively, a solid material or hollow material may be formed with the desired exterior profile shape without the use of any resilient covering. The perimeter handle construction is therefore not meant to be limiting.

Figure 10:
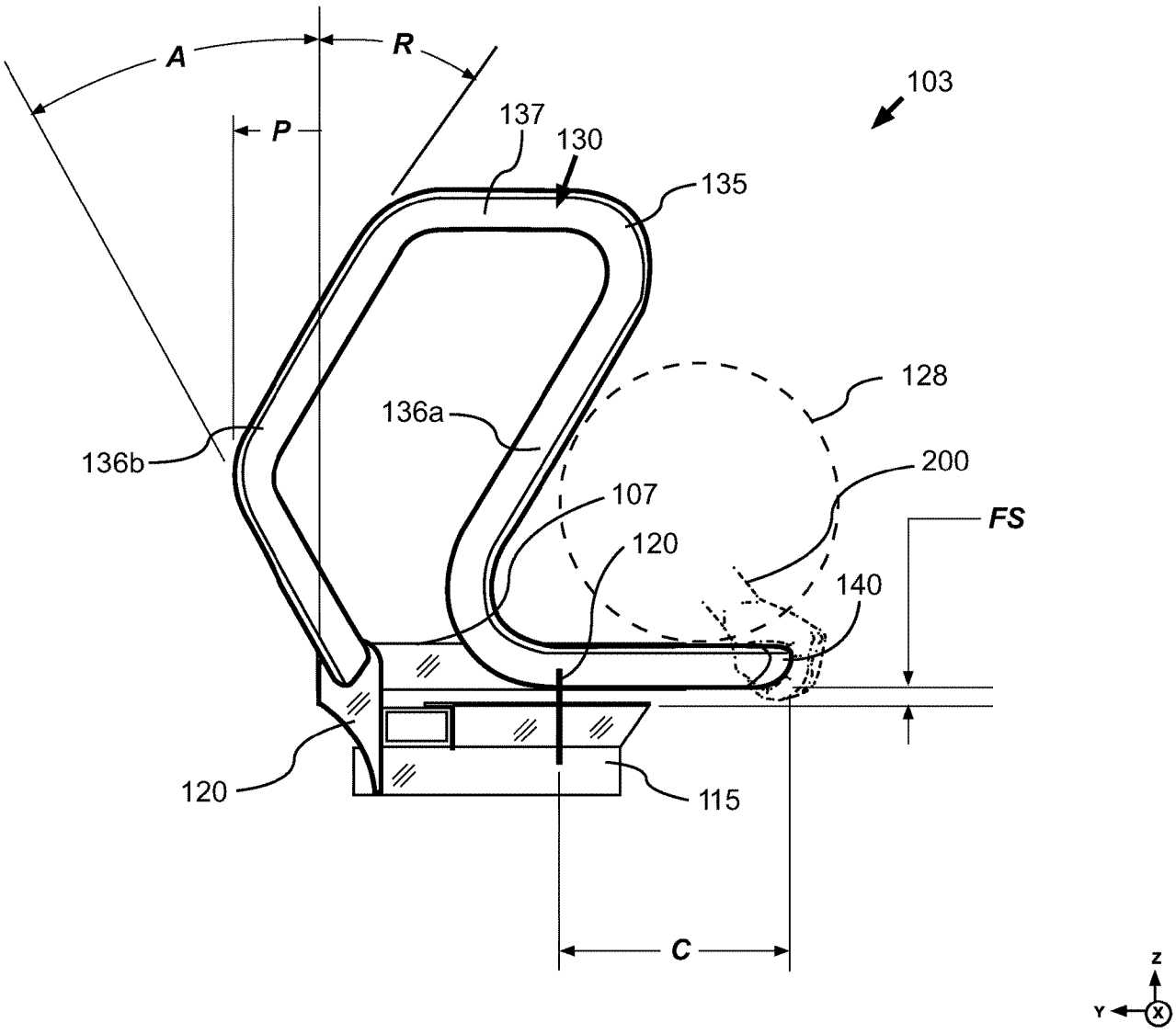
FIG. 10 is an exemplary diagram showing a side view of a front handle assembly of an exercise machine in accordance with an example embodiment.

FIG. 10 is an exemplary diagram showing a side view of a front handle assembly 103 of an exercise machine. More specifically, as previously described, the front handle 130 wraps continuously from an attachment point at a right end connector 125, laterally along the X axis, curving upward, then forward, downward and forward in the Y-Z plane, then distally across the front of the machine, continuing with a left side geometry that would preferably be a mirror image of the right side geometry, although the view of the left side of the front handle 130 is obscured by the right side of the handle 130.

In addition to the first and last handle end point attachment to the end connectors 125, the handle 130 is further supported elevated above the front platform structure 115 by one connector 120 each on the right and left side of the handle.

As can be seen, a cantilevered portion of the handle C overhanging the front end of the exercise machine is devoid of any support structures that would otherwise restrict where the exerciser's hand 200 may be permitted to grip the cantilevered portion of the handle 130. Further, the height of the connector 120 above the upper surface of the front platform structure 115 provides for a finger space FS to allow for the fingers of the exerciser's hand 200 to wrap completely around and underneath the lower surface of the handle 130 at any point except at the precise location of the left and right connectors 120.

After projecting laterally along the X axis from the end connectors 125, the handle curves upward at a preferred angle A relative to the Y-Z plane, with the first upwardly angled portion projecting a distance P beyond the back edge of the front platform pad 107 and towards the front of the exercise carriage 105. The projection of the handle 130 towards the exercise carriage 105 provides the exerciser with a useful and easily accessible gripping structure to provide stability during exercising while the torso is positioned proximate to the upper surface of the carriage pad 112.

After extending upwardly at the preferred angle, the handle 130 then reverses its upward direction at an angle R thereby providing for an upper portion of the handle 130 with a useful and convenient gripping surface while positioned in a standing or crouching position on the carriage pad 112. Further, the substantially horizontal uppermost portion of the handle 130 provides a stable and easily accessible gripping structure while standing on the front platform pad 107 or while positioned with one foot on the platform pad 107 and the carriage pad 112.

Finally, so as to not interfere with lateral elbow or lower arm movement while gripping the front end of the handle 130 as shown with the illustrative hand 200, the downward projecting front portion of the handle 130 returns toward the platform pad 107 forming an acute angle between the downwardly projection handle portion and the substantially horizontal front portion of the handle 130, the positioning of the acute angle thereby providing an unobstructed area 128 indicated by the dashed line for the elbows and lower arms to extend laterally without the encountering handle interference to the movement.

Figure 11:
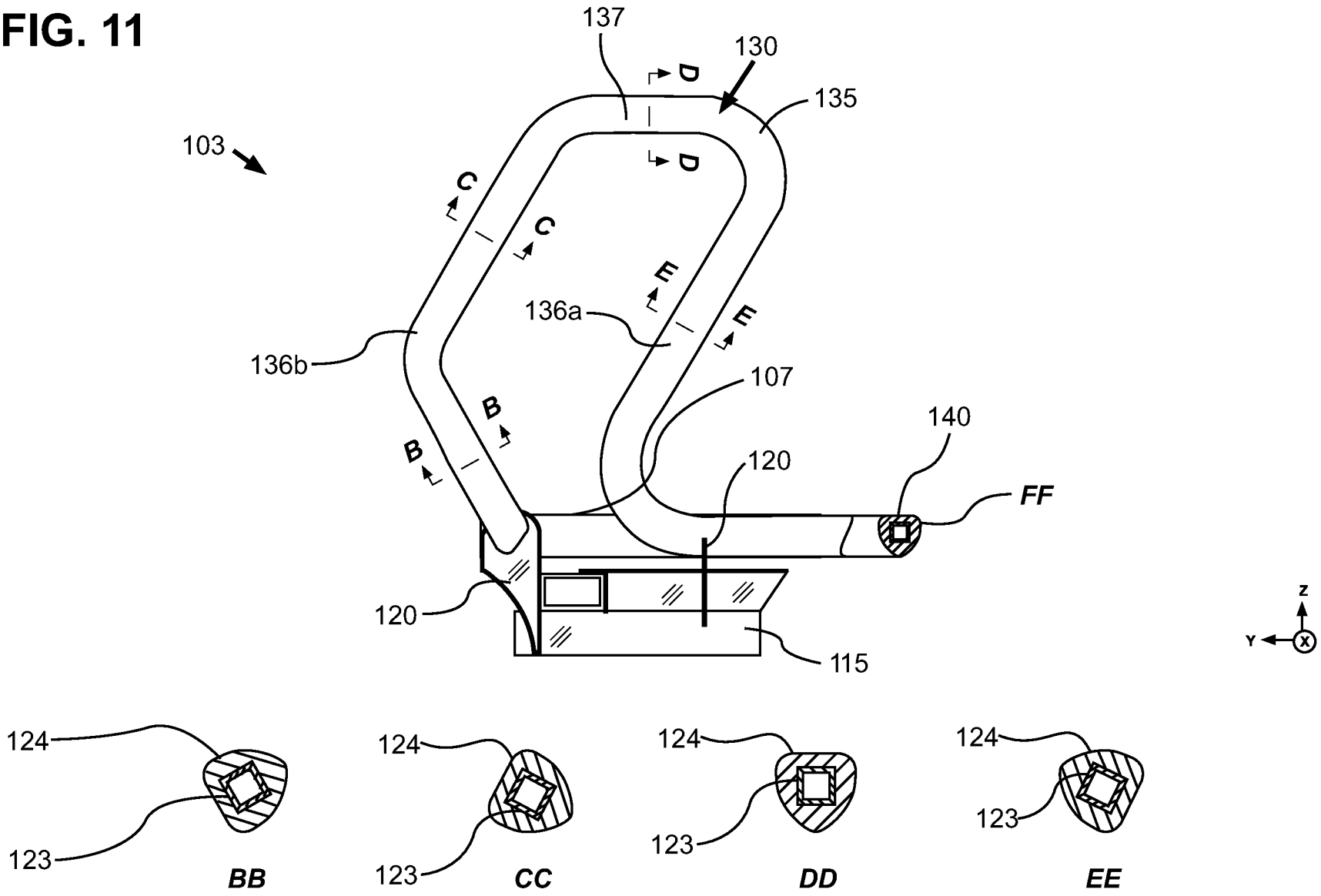
FIG. 11 is an exemplary diagram showing handle sections in a side view of a front handle assembly in accordance with an example embodiment.

FIG. 11 is an exemplary diagram showing handle sections in a side view of a front platform 103 comprising at least a front platform handle 130. Although any solid or tubular material and profile shape may be used to create the front platform handle 130, for instance a readily available round or rectangular tubing bar meeting the structural requirements of exercise machine handles, the handle geometry shows a substantially acute triangular shaped outer profile.

In the drawing, section FF of the cut away portion of the handle 130 shows a substantially triangular handle profile with the substantially flattened base of the triangular section facing upwards as may be preferred to more comfortably distribute the weight of an exerciser over a larger area when compared to exerting the exerciser's weight against the narrow intersection of adjacent sides of the triangle. The profile of the handle 130 follows the continuous geometric path as shown in section EE with the flat portion of the handle 130 facing the front of the machine, section DD at the top section of the handle 130 with the flat portion facing upward, section CC with the flat portion of the handle 130 facing upward and substantially towards the back of the machine, and section BB with the flatted portion of the handle 130 facing downward and toward the back of the machine.

As one exemplary method of fabricating the handle profile, a preferred handle profile may comprise a rectangular handle structure 123 encased by a resilient cover 124, the resilient cover 124 providing additional weight bearing cushioning while also functioning to reduce the slipperiness of the handle 130 when grasped with perspiring hands or feet.

Figure 12:
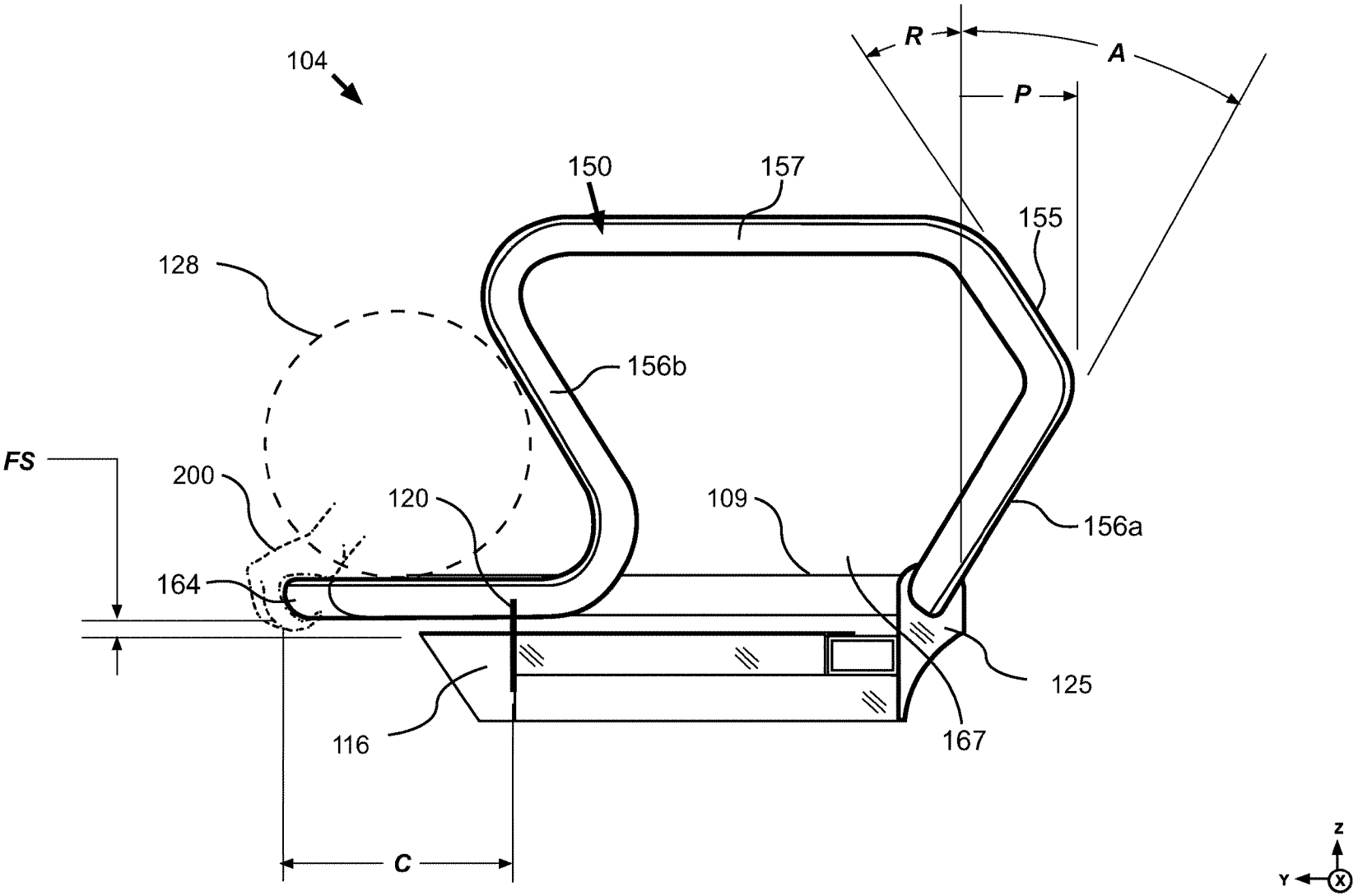
FIG. 12 is an exemplary diagram showing a side view of a back handle assembly in accordance with an example embodiment.

FIG. 12 is an exemplary diagram showing a side view of a back handle assembly 104. More specifically, as previously described, the back handle 150 wraps continuously from an attachment point at a right end connector 125, laterally along the X axis, curving upward, then backward, downward and backward in the Y-Z plane, then distally across the back of the machine in the X-Y plane, continuing with a left side geometry that would preferably be a mirror image of the right side geometry, although the view of the left side of the handle 150 is obscured by the right side of the handle 150.

In addition to the first and last handle end points of attachment to the end connectors 125, the handle 150 is further supported above the back platform structure 116 by use of one connector 120 each on the right and left side of the handle 150.

As can be seen, a cantilevered portion C of the handle 150 overhanging the back end of the exercise machine is devoid of any support structures that would otherwise restrict where the exerciser's hand 200 may be permitted to grip the cantilevered portion of the handle 150. Further, the height of the connector 120 above the upper surface of the back platform structure 116 provides for a finger space FS to allow for the fingers of the exerciser's hand 200 to wrap completely around and underneath the lower surface of the handle 150 at any point except at the precise location of the left and right connectors 120.

After projecting laterally along the X axis from the end connectors 125, the handle curves upward at an angle A relative to the Y-Z plane, with the first upwardly angled portion projecting a distance P beyond the front edge of the back platform pad 109 and towards the exercise carriage 105. The projection of the handle 150 towards the exercise carriage 105 provides the exerciser with a useful and easily accessible gripping structure to provide stability during exercising while the torso is positioned proximate to the upper surface of the carriage pad 112.

After extending upwardly at the preferred angle, the handle 150 then reverses its upward direction at a preferred angle R thereby forming an upper portion of the handle 150 that provides for a useful and convenient gripping surface while positioned in a standing or crouching position on the carriage pad 112.

Further, the substantially horizontal uppermost portion of the handle 150 provides a stable and easily accessible gripping structure while standing on the back platform pad 109 or positioned with one foot on the platform pad 109 and one foot on the carriage pad 112.

Finally, so as to not interfere with lateral elbow or lower arm movement while gripping the back end of the handle 150 as shown with the illustrative hand 200, the downward projecting back portion of the handle 150 returns toward the platform pad 109 forming an acute angle between the downwardly projection handle portion and the substantially horizontal back portion of the handle 150, the positioning of the acute angle thereby creating an unobstructed area 128 indicated by the dashed line for the elbows and lower arms to extend laterally without the encountering handle interference to the movement.

Figure 13:
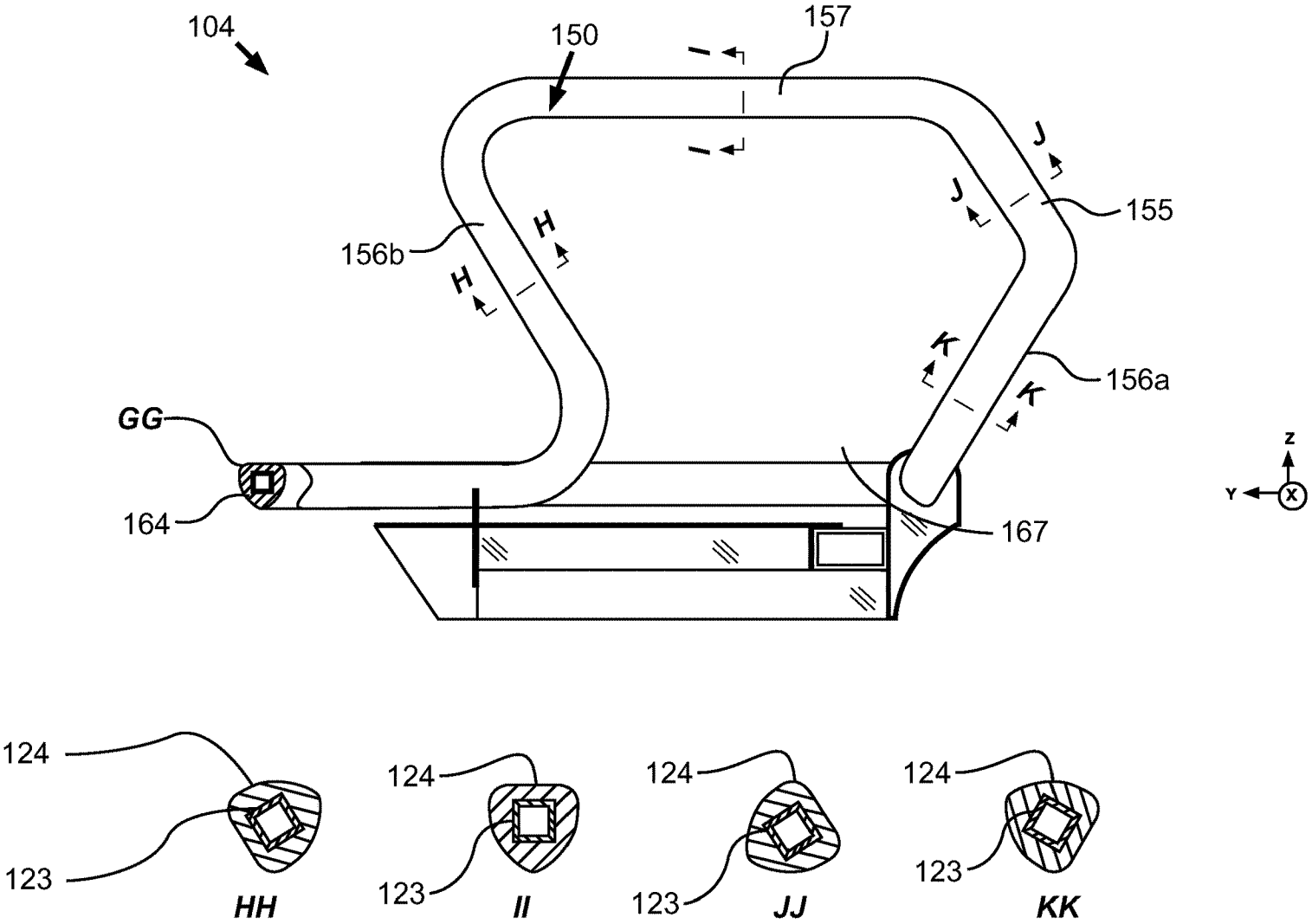
FIG. 13 is an exemplary diagram showing handle sections in a side view of a back handle assembly in accordance with an example embodiment.

FIG. 13 is an exemplary diagram showing handle sections in a side view of a back handle assembly 104.

In the drawing, section GG of the cut away portion of the handle 150 shows a substantially triangular handle profile with the substantially flattened base of the triangular section facing upwards as may be preferred to more comfortably distribute the weight of an exerciser over a larger handle surface area. The profile of the handle 150 follows the continuous geometric path as shown in section HH with the flat portion of the handle 150 facing the back of the machine, section II at the top section of the handle 150 with the flat portion facing upward, section JJ with the flat portion of the handle 150 facing upward and substantially towards the front of the machine, and section KK with the flatted portion of the handle facing downward and toward the front of the machine.

As previously described, a preferred handle profile comprises a rectangular handle structure 123 encased by a resilient cover 124, the resilient cover 124 providing additional weight bearing cushioning while also functioning to reduce the slipperiness of the handle when grasped with perspiring hands or feet.

It should be appreciated that a wide range of exercise machines may benefit from the use of the handles 110, 130, 150 shown and described herein. For example, any exercise machine which includes an exercise carriage 105 may benefit from use of a perimeter handle 110. Similarly, any exercise machine which includes one or more fixed platforms 103, 104 may benefit from front and/or back platform handles 130, 150. Thus, the scope of the present disclosure should not be construed as limited to any particular type of exercise machine, including the exemplary embodiments shown in the figures, as the systems and methods described herein would similarly benefit a wide range of additional exercise machines known in the art.

The front and back platform handles 130, 150 are each configured so as to maximize the gripping surfaces available to the exerciser. To further this aim, the platform handle 130, 150 will each generally be connected to the exercise machine with a limited number of connectors 120, 125. With proper positioning of the connectors 120, 125, the number of connectors 120, 125 necessary for a secure connection between the respective platform handles 130, 150 and the exercise machine may be minimized, thus maximizing the available gripping portions on the platform handles 130, 150 for the exerciser to grasp.

The manner in which the platform handles 130, 150 are connected to the exercise machine may vary in different embodiments. In some embodiments, the platform handles 130, 150 may be interconnected directly with the corresponding platform pad 107, 109, with the front platform handle 130 being connected to the front platform pad 107 and the back platform handle 150 being connected to the back platform pad 109.

In other embodiments, the platform handles 130, 150 may be connected instead directly to the exercise machine itself, such as to the base support assembly 100 of the exercise machine. In yet other embodiments, a hybrid configuration may be used, with the platform handles 130, 150 being connected to both the corresponding platform pad 107, 109 and the exercise machine itself, such as the base support assembly 100.

The figures illustrate exemplary connection points which minimize the number of connectors 120, 125 used while maximizing the gripping surfaces available to the exerciser on each of the platform handles 130, 150. By way of example and without limitation, FIG. 3 illustrates exemplary connector 120, 125 locations for a perimeter handle 110, front platform handle 130, and back platform handle 150.

As shown in FIG. 3, the front platform handle 130 may be connected using only four connectors 120, 125. As can be seen, a first connector 120 is connected between a first side of the front platform handle 130 and the exercise machine near the front end of the front platform handle 130. A second connector 120 is connected between a second side of the front platform handle 130 and the exercise machine near the front end of the front platform handle 130. A pair of end connectors 125 are connected between the connector ends 143, 144 of the front platform handle 130 and the front platform pad 107.

Such a connection configuration is also shown in FIGS. 1, 2A, and 2B, which minimizes the number of connectors 120, 125 necessary to firmly mount the front platform handle 130 to the exercise machine while maximizing the gripping surfaces available on the front platform handle 130 for an exerciser to use.

Continuing to reference FIG. 3, the perimeter handle 110 is shown connected to the exercise machine by use of four connectors 120. As the exemplary embodiment of a perimeter handle 110 illustrated in FIG. 3 is a continuous loop, end connectors 125 have been omitted. As can be seen, a connector 120 has been connected between a position offset from the four corners of the perimeter handle 110 and the exercise machine. Such a configuration maximizes the gripping surfaces available on the perimeter handle 110 for use by the exerciser.

FIG. 3 also shows exemplary connection points for the back platform handle 150. As shown, the back platforms handle 150 may be cantilevered such that it is primarily secured using the front half of the back platform handle 150 structure. A pair of connectors 120 is illustrated as being connected between the exercise machine and a position on the front half of the back platform handle 150. A pair of end connectors 150 is shown connected between the back platform pad 109 and the sides of the front end of the back platform handle 150. Such a configuration maximizes the available gripping surfaces along the back platform handle 150 for use by the exerciser.

The type of connectors 120, 125 used with the exercise machine handle system may vary in different embodiments. By way of example, the connectors 120, 125 could comprise stanchions, brackets, clamps, clasps, rods, fasteners, elongated members, straps, and the like. Thus, the shape, size, and configuration of the exemplary connectors 120, 125 shown in the figures should not be construed as limiting in scope. Further, while exemplary positioning of the different connectors 120, 125 has been shown for illustrative purposes, it should be appreciated that the number, positioning, and orientation of the connectors 120, 125 may vary in different embodiments and similarly should not be construed as limiting in scope.

FIGS. 14-16 illustrate an exemplary embodiment of a back platform handle 150. The shape and configuration of the back platform handle 150 is merely for illustrative purposes and should not be construed as limiting in scope. In the exemplary embodiment shown in FIGS. 14-16, it can be seen that the back platform handle 150 comprises a first side portion 151 and a second side portion 155 which each extend above the upper surface of the back platform pad 109. The first and second side portions 151, 155 may be mirrors of each other or may be different configurations.

The first side portion 151 of the back platform handle 150 may comprise a pair of rising members 152*a*, 152*b* which extend diagonally or vertically upward to rise over the upper surface of the back platform pad 109. As can be seen the first rising member 152*a* is angled toward the front of the back platform pad 109 and the second rising member 152*b* is angled toward the back of the back platform pad 109. A first gap 166 is shown between the first and second rising members 152*a*, 152*b* of the first side portion 151 and a second gap 167 is shown between the first and second rising members 156*a*, 156*b* of the second side portion 155. The respective distal upper ends of the rising members 152*a*, 152*b* are linked together by a cross member 153 which may extend substantially horizontally in parallel orientation with the ground surface.

The second side portion 155 of the back platform handle 150 may similarly comprise a pair of rising members 156*a*, 156*b* which extend diagonally or vertically upward to rise over the upper surface of the back platform pad 109. As can be seen the first rising member 156*a* is angled toward the front of the back platform pad 109 and the second rising member 152*b* is angled toward the back of the back platform pad 109. The respective distal upper ends of the rising members 156*a*, 156*b* are linked together by a cross member 157 which may extend substantially horizontally in parallel orientation with the ground surface. The back platform handle 150 may also include a front portion 160 which extends between the first rising member 152*a* of the first side portion 151 and the first rising member 156*a* of the second side portion 155. The front portion 160 may comprise a pair of connector ends 161, 162 which terminate into one or more end connectors 125 which are connected to the back platform pad 109.

The rear portion 164 of the back platform handle 150 includes a cross member 165 which extends between the second rising member 152*b* of the first side portion 151 and the second rising member 156*b* of the second side portion 155. The front and rear portions 160, 164 may be at the same elevation or may be at different elevations. The front and rear portions 160, 164 may be offset with respect to the underlying exercise machine to ensure there is room underneath the front and rear portions 160, 164 for the fingers of an exerciser.

FIGS. 17-19 illustrate an exemplary embodiment of a front platform handle 130. The shape and configuration of the front platform handle 130 is merely for illustrative purposes and should not be construed as limiting in scope. In the exemplary embodiment shown in FIGS. 17-19, it can be seen that the front platform handle 130 comprises a first side portion 131 and a second side portion 135 which each extend above the upper surface of the front platform pad 107. The first and second side portions 131, 135 may be mirrors of each other or may be different configurations.

The first side portion 131 of the front platform handle 130 may comprise a pair of rising members 132*a*, 132*b* which extend vertically and/or diagonally upward to rise over the surface of the front platform pad 107. In the illustrated embodiment, both the first and second rising members 132*a*, 132*b* of the front platform handle 130 are shown as being angled toward the front end of the front platform handle 130. A first gap 146 is shown between the first and second rising members 132*a*, 132*b* of the first side portion 131. The respective distal upper ends of the rising members 132*a*, 132*b* are linked together by a cross member 133 which may extend substantially horizontally in parallel orientation with the ground surface.

The second side portion 135 of the front platform handle 130 may similarly comprise a pair of rising members 136*a*, 136*b* which extend diagonally or vertically upward to rise over the upper surface of the front platform pad 107. A second gap 147 is shown between the first and second rising members 136*a*, 136*b* of the second side portion 135. As can be seen, the first rising member 156*a* and second rising member 156*b* are each shown as being angled toward the front end of the front platform handle 130. The respective distal upper ends of the rising members 136*a*, 136*b* are linked together by a cross member 137 which may extend substantially horizontally in parallel orientation with the ground surface.

The front platform handle 130 may also include a front portion 140 which includes a cross member 141 which extends between the first rising member 132*a* of the first side portion 131 and the first rising member 136*a* of the second side portion 135. The front platform handle 130 may also include a back portion 142 which extends between the second rising member 132*b* of the first side portion 131 and the second rising member 136*b* of the second side portion 135. The back portion 142 may comprise a pair of connector ends 143, 144 which terminate into one or more end connectors 125 which are connected to the front platform pad 107.

Those skilled in the art will immediately recognize that the fully continuous and substantially continuous handle geometries, handle mounting methods and handle profile shape considerably expand the functionality of an resistance exercise machine, enhance the safety and stability of exercisers, and improve the user interaction experience delivered via the innovative support structures as described.

Unless otherwise defined, all technical and scientific terms used herein have the same meaning as commonly understood by one of ordinary skill in the art to which this invention belongs. Although methods and materials similar to or equivalent to those described herein can be used in the practice or testing of the exercise machine handle system, suitable methods and materials are described above. All patent applications, patents, and printed publications cited herein are incorporated herein by reference in their entireties, except for any definitions, subject matter disclaimers or disavowals, and except to the extent that the incorporated material is inconsistent with the express disclosure herein, in which case the language in this disclosure controls. The exercise machine handle system may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. An exercise machine, comprising:

a frame;

a first end platform connected to the frame, wherein the first end platform is positioned near a first end of the frame;

a carriage movably positioned upon the frame, wherein the carriage includes a carriage pad;

wherein the carriage pad includes an outer edge, and wherein the carriage pad includes an upper surface adapted to support an exerciser during an exercise; and a perimeter handle connected to the carriage, wherein the perimeter handle surrounds the carriage pad of the carriage, wherein the perimeter handle includes an inner edge;

wherein the perimeter handle is spaced-apart with respect to the carriage pad so as to define a space between the outer edge of the carriage pad and the inner edge of the perimeter handle.

2. The exercise machine of claim 1, wherein the perimeter handle is connected to the carriage by a plurality of connectors.

3. The exercise machine of claim 2, wherein the plurality of connectors are connected to a lower surface of the perimeter handle.

4. The exercise machine of claim 3, wherein the plurality of connectors are connected to the carriage below the carriage pad.

5. The exercise machine of claim 2, wherein the perimeter handle comprises a first side portion, a second side portion opposite of the first side portion, a first end portion extending between the first side portion and the second side portion, and a second end portion opposite of the first end portion extending between the first side portion and the second side portion, and wherein the plurality of connectors are comprised of a plurality of first connectors connected to the first side portion of the perimeter handle and a plurality of second connectors connected to the second side portion of the perimeter handle.

6. The exercise machine of claim 5, wherein the plurality of first connectors and the plurality of second connectors are spaced apart from the first end portion and the second end portion of the perimeter handle.

7. The exercise machine of claim 6, wherein the first end portion and the second end portion of the perimeter handle are supported in a cantilevered manner by the first side portion and the second side portion of the perimeter handle.

8. The exercise machine of claim 2, wherein the plurality of connectors are each comprised of a thin connector.

9. The exercise machine of claim 1, wherein the outer edge of the carriage pad comprises a first side edge, a second side edge opposite of the first side edge, a first end edge extending between the first side edge and the second side edge, and a second end edge opposite of the first end edge extending between the first side edge and the second side edge, and wherein the perimeter handle comprises a first side portion, a second side portion opposite of the first side portion, a first end portion extending between the first side portion and the second side portion, and a second end portion opposite of the first end portion extending between the first side portion and the second side portion.

10. The exercise machine of claim 9, wherein the perimeter handle is comprised of a rectangular shape.

11. The exercise machine of claim 9, wherein the first side edge of the carriage pad is parallel to the first side portion of the perimeter handle, wherein the second side edge of the carriage pad is parallel to the second side portion of the perimeter handle, wherein the first end edge of the carriage pad is parallel to the first end portion of the perimeter handle, and wherein the second end edge of the carriage pad is parallel to the second end portion of the perimeter handle.

12. The exercise machine of claim 1, further comprising a second end platform connected to the frame, wherein the second end platform is positioned near a second end of the frame.

13. An exercise machine, comprising:

a frame;

a first end platform connected to the frame, wherein the first end platform is positioned near a first end of the frame;

a carriage movably positioned upon the frame, wherein the carriage includes a carriage pad;

wherein the carriage pad includes an outer edge, and wherein the carriage pad includes an upper surface adapted to support an exerciser during an exercise; wherein the outer edge of the carriage pad comprises a first side edge, a second side edge opposite of the first side edge, a first end edge extending between the first side edge and the second side edge, and a second end edge opposite of the first end edge extending between the first side edge and the second side edge; and a perimeter handle connected to the carriage by a plurality of connectors, wherein the perimeter handle surrounds the carriage pad of the carriage, wherein the perimeter handle includes an inner edge;

wherein the perimeter handle is spaced-apart with respect to the carriage pad so as to define a space between the outer edge of the carriage pad and the inner edge of the perimeter handle;

wherein the perimeter handle comprises a first side portion, a second side portion opposite of the first side portion, a first end portion extending between the first side portion and the second side portion, and a second end portion opposite of the first end portion extending between the first side portion and the second side portion;

wherein the first side edge of the carriage pad is parallel to the first side portion of the perimeter handle, wherein the second side edge of the carriage pad is parallel to the second side portion of the perimeter handle, wherein the first end edge of the carriage pad is parallel to the first end portion of the perimeter handle, and wherein the second end edge of the carriage pad is parallel to the second end portion of the perimeter handle.

14. The exercise machine of claim 13, wherein the plurality of connectors are connected to a lower surface of the perimeter handle.

15. The exercise machine of claim 14, wherein the plurality of connectors are connected to the carriage below the carriage pad.

16. The exercise machine of claim 13, wherein the plurality of connectors are comprised of a plurality of first connectors connected to the first side portion of the perimeter handle and a plurality of second connectors connected to the second side portion of the perimeter handle.

17. The exercise machine of claim 16, wherein the plurality of first connectors and the plurality of second connectors are spaced apart from the first end portion and the second end portion of the perimeter handle.

18. The exercise machine of claim 17, wherein the first end portion and the second end portion of the perimeter handle are supported in a cantilevered manner by the first side portion and the second side portion of the perimeter handle.

19. The exercise machine of claim 13, wherein the plurality of connectors are each comprised of a thin connector.

20. An exercise machine, comprising:

a frame;

a first end platform connected to the frame, wherein the first end platform is positioned near a first end of the frame;

a carriage movably positioned upon the frame, wherein the carriage includes a carriage pad;

wherein the carriage pad includes an outer edge, and wherein the carriage pad includes an upper surface adapted to support an exerciser during an exercise; wherein the outer edge of the carriage pad comprises a first side edge, a second side edge opposite of the first side edge, a first end edge extending between the first side edge and the second side edge, and a second end edge opposite of the first end edge extending between the first side edge and the second side edge; and a perimeter handle connected to the carriage by a plurality of connectors, wherein the perimeter handle surrounds the carriage pad of the carriage, wherein the perimeter handle includes an inner edge;

wherein the perimeter handle is comprised of a rectangular shape;

wherein the plurality of connectors are connected to a lower surface of the perimeter handle;

wherein the perimeter handle is spaced-apart with respect to the carriage pad so as to define a space between the outer edge of the carriage pad and the inner edge of the perimeter handle;

wherein the perimeter handle comprises a first side portion, a second side portion opposite of the first side portion, a first end portion extending between the first side portion and the second side portion, and a second end portion opposite of the first end portion extending between the first side portion and the second side portion;

wherein the first side edge of the carriage pad is parallel to the first side portion of the perimeter handle, wherein the second side edge of the carriage pad is parallel to the second side portion of the perimeter handle, wherein the first end edge of the carriage pad is parallel to the first end portion of the perimeter handle, and wherein the second end edge of the carriage pad is parallel to the second end portion of the perimeter handle;

wherein the plurality of connectors are comprised of a plurality of first connectors connected to the first side portion of the perimeter handle and a plurality of second connectors connected to the second side portion of the perimeter handle;

wherein the plurality of first connectors and the plurality of second connectors are spaced apart from the first end portion and the second end portion of the perimeter handle.

* * * * *